US011559094B2

(12) United States Patent
Kehler et al.

(10) Patent No.: US 11,559,094 B2
(45) **Date of Patent: *Jan. 24, 2023**

(54) TRAINING TIGHT WITH PRECONFIGURED COMPRESSION ZONES AND INTEGRATED STRUCTURE PATTERNS

(71) Applicant: NIKE, Inc., Beaverton, OR (US)

(72) Inventors: Alyse Kehler, Portland, OR (US); Richa Maheshwari, Hillsboro, OR (US); Christopher J. Ranalli, Portland, OR (US); Andrea J. Staub, Portland, OR (US); Heidi A. Vaughan, Lake Oswego, OR (US)

(73) Assignee: NIKE, Inc., Beaverton, OR (US)

( * ) Notice: Subject to any disclaimer, the term of this patent is extended or adjusted under 35 U.S.C. 154(b) by 255 days.

This patent is subject to a terminal disclaimer.

(21) Appl. No.: 16/983,339

(22) Filed: Aug. 3, 2020

(65) Prior Publication Data

US 2020/0360754 A1 Nov. 19, 2020

Related U.S. Application Data

(63) Continuation of application No. 16/286,155, filed on Feb. 26, 2019, now Pat. No. 10,765,902, which is a (Continued)

(51) Int. Cl.
*A41B 11/00* (2006.01)
*A41D 31/18* (2019.01)
(Continued)

(52) U.S. Cl.
CPC ..... *A41D 31/18* (2019.02); *A41D 13/0015* (2013.01); *A63B 21/00178* (2013.01);
(Continued)

(58) Field of Classification Search
CPC ..... A41B 11/003; D04B 9/46; A41D 1/06; A41D 13/0015
See application file for complete search history.

(56) References Cited

U.S. PATENT DOCUMENTS 1,367,065 A 2/1921 McCrahon
1,817,053 A 8/1931 Zerk
(Continued)

FOREIGN PATENT DOCUMENTS

CN 1764394 A 4/2006
CN 1765247 A 5/2006
(Continued)

OTHER PUBLICATIONS

Office Action received for European Patent Application No. 20178086.3, dated Apr. 12, 2021, 3 pages.
(Continued)

*Primary Examiner* — Tajash D Patel
(74) *Attorney, Agent, or Firm* — Shook, Hardy & Bacon L.L.P.

(57) ABSTRACT

A training tight having preconfigured compression zones with integrated knit structure patterns is provided herein. The compression zones may have differing compressive properties where zones having a higher compression force are located at the waist and thigh areas of the tight, and zones having a lower compression force are located at the knee and calf area of the tight. The integrated structure patterns modify the compressive properties of the zones in the areas where the patterns are located in order to further customize the compressive properties of the training tight.

20 Claims, 17 Drawing Sheets

Related U.S. Application Data continuation of application No. 15/151,924, filed on May 11, 2016, now Pat. No. 10,265,564.

(60) Provisional application No. 62/165,478, filed on May 22, 2015.

(51) Int. Cl.

| | |
|---|---|
| ***A63B 21/00*** | (2006.01) |
| ***A63B 23/02*** | (2006.01) |
| ***A41D 13/00*** | (2006.01) |
| ***D04B 21/18*** | (2006.01) |
| ***D04B 21/20*** | (2006.01) |

(52) U.S. Cl.

CPC ..... *A63B 23/0205* (2013.01); *A63B 23/0238* (2013.01); *D04B 21/18* (2013.01); *D04B 21/207* (2013.01); *D10B 2501/02* (2013.01); *D10B 2501/021* (2013.01)

(56) References Cited

U.S. PATENT DOCUMENTS

| | | | | |
|---|---|---|---|---|
| 3,063,271 | A | 11/1962 | Faust et al. | |
| 3,429,147 | A | 2/1969 | Perrier | |
| 3,703,820 | A | 11/1972 | Jackson | |
| 3,748,870 | A | 7/1973 | Fregeolle | |
| 4,027,667 | A | 6/1977 | Swallow et al. | |
| 4,086,790 | A | 5/1978 | Hanrahan et al. | |
| 4,089,064 | A | 5/1978 | Chandler, Jr. | |
| 4,156,294 | A | 5/1979 | Horn | |
| 4,172,456 | A | 10/1979 | Zens | |
| 4,176,665 | A | 12/1979 | Terpening | |
| 4,180,065 | A | 12/1979 | Bowen | |
| 4,213,312 | A | 7/1980 | Cassidy et al. | |
| 4,240,160 | A | 12/1980 | Imboden et al. | |
| 4,422,307 | A | 12/1983 | Thorneburg | |
| 4,502,301 | A | 3/1985 | Swallow et al. | |
| 4,513,740 | A | 4/1985 | Westlake | |
| 4,527,403 | A | 7/1985 | Fullbright et al. | |
| 5,125,116 | A | 6/1992 | Gaither et al. | |
| 5,367,708 | A | 11/1994 | Fujimoto | |
| 5,581,817 | A | 12/1996 | Hicks | |
| 5,720,042 | A | 2/1998 | Wilkinson | |
| 5,823,013 | A | 10/1998 | Lonati et al. | |
| 6,012,177 | A | 1/2000 | Cortinovis | |
| 6,047,406 | A | 4/2000 | Dicker et al. | |
| 6,053,852 | A | 4/2000 | Wilkinson | |
| 6,119,491 | A | 9/2000 | Pinelli | |
| 6,216,495 | B1 | 4/2001 | Couzan et al. | |
| 6,231,488 | B1 | 5/2001 | Dicker et al. | |
| 6,341,506 | B1 | 1/2002 | Myers | |
| 7,048,013 | B2 | 5/2006 | Shannon | |
| 7,159,621 | B2 | 1/2007 | Shannon | |
| 7,434,423 | B1 | 10/2008 | Reid et al. | |
| 7,481,079 | B1 | 1/2009 | Waldrop et al. | |
| 7,856,668 | B2 | 12/2010 | Demarest et al. | |
| 8,172,782 | B2 | 5/2012 | Rock | |
| 8,296,864 | B2 | 10/2012 | Torry | |
| 8,425,324 | B2 | 4/2013 | Kemmerling | |
| 8,578,512 | B2 | 11/2013 | Moore et al. | |
| 9,777,413 | B2 | 10/2017 | Messier | |
| 9,850,601 | B2 | 12/2017 | Shen et al. | |
| 10,265,564 | B2 | 4/2019 | Kehler et al. | |
| 10,765,902 | B2 * | 9/2020 | Kehler | D04B 21/207 |
| 2001/0013138 | A1 | 8/2001 | Myers | |
| 2002/0152775 | A1 | 10/2002 | Browder | |
| 2003/0192351 | A1 | 10/2003 | Meckley et al. | |
| 2006/0169004 | A1 | 8/2006 | Belluye et al. | |
| 2006/0277950 | A1 | 12/2006 | Rock | |
| 2008/0120757 | A1 | 5/2008 | Nakazawa | |
| 2008/0189824 | A1 | 8/2008 | Rock et al. | |
| 2008/0295216 | A1 | 12/2008 | Nordstrom et al. | |
| 2010/0130903 | A1 | 5/2010 | Rock | |
| 2011/0257575 | A1 | 10/2011 | Farrow et al. | |
| 2011/0302686 | A1 | 12/2011 | Chapuis | |
| 2012/0117706 | A1 | 5/2012 | Tateo | |
| 2012/0174282 | A1 | 7/2012 | Newton et al. | |
| 2013/0186150 | A1 | 7/2013 | Pilawa et al. | |
| 2013/0254971 | A1 | 10/2013 | Galluzzo et al. | |
| 2014/0000005 | A1 | 1/2014 | Berns et al. | |
| 2014/0075656 | A1 | 3/2014 | Chang | |
| 2014/0082815 | A1 | 3/2014 | Harber et al. | |
| 2014/0090142 | A1 | 4/2014 | Waller et al. | |
| 2014/0289924 | A1 | 10/2014 | Cleveland | |
| 2014/0366585 | A1 | 12/2014 | Shen et al. | |
| 2015/0025435 | A1 | 1/2015 | Sherman | |
| 2015/0051524 | A1 | 2/2015 | Messier | |
| 2015/0196067 | A1 | 7/2015 | Blakely | |
| 2015/0224011 | A1 | 8/2015 | Scott et al. | |
| 2016/0150835 | A1 | 6/2016 | Salmini et al. | |
| 2016/0338417 | A1 | 11/2016 | Kehler et al. | |
| 2016/0338424 | A1 | 11/2016 | Kehler et al. | |
| 2016/0339286 | A1 | 11/2016 | Kehler et al. | |
| 2017/0295871 | A1 * | 10/2017 | Sugino | A41D 1/08 |
| 2018/0035727 | A1 | 2/2018 | Cumiskey et al. | |
| 2018/0049482 | A1 | 2/2018 | Erkus et al. | |
| 2018/0249775 | A1 | 9/2018 | Pitchforth et al. | |
| 2018/0279694 | A1 | 10/2018 | Theno et al. | |
| 2019/0192894 | A1 | 6/2019 | Kehler et al. | |
| 2019/0380408 | A1 | 12/2019 | Tanzman | |
| 2020/0196684 | A1 * | 6/2020 | Dillinger | A41H 42/00 |

FOREIGN PATENT DOCUMENTS

| | | | |
|---|---|---|---|
| CN | 1981653 | A | 6/2007 |
| CN | 101677636 | A | 3/2010 |
| CN | 201563647 | U | 9/2010 |
| CN | 102271544 | A | 12/2011 |
| CN | 203072932 | U | 7/2013 |
| CN | 104168970 | A | 11/2014 |
| EP | 0964091 | A2 | 12/1999 |
| EP | 2543267 | A1 | 1/2013 |
| FR | 2598535 | A1 | 11/1987 |
| FR | 2958535 | A1 | 10/2011 |
| GB | 803083 | A | 10/1958 |
| GB | 2117805 | A | 10/1983 |
| JP | 3-279403 | A | 12/1991 |
| JP | 5-125601 | A | 5/1993 |
| JP | 11-158704 | A | 6/1999 |
| WO | 2009/135474 | A1 | 11/2009 |
| WO | 2012/164300 | A1 | 12/2012 |
| WO | 2014/041075 | A1 | 3/2014 |

OTHER PUBLICATIONS

Notice of Allowance received for Canadian Patent Application No. 2,985,616, dated Feb. 28, 2022, 1 page.

Notice of Allowance received for Canadian Patent Application No. 2,986,586, dated Feb. 18, 2022, 1 page.

Extended European Search Report received for European Patent Application No. 20178086.3, dated Sep. 15, 2020, 7 pages.

Notice of Allowance received for Canadian Patent Application No. 2986589, dated Apr. 28, 2022, 1 page.

"1×1 Rib Texture Merino Wool Knit Tights Double Gusset Yellow", Available on Internet at: <https://www.robaversand.com/en/11ribtexturemerinowoolknittightsdoublegussetyellow.html>, Accessed on Feb. 25, 2015, 8 pages.

"Maruska Tights", Anthropologie.com, Available on Internet at: <https://www.anthropologie.eom/shop/maruska-tights#/>, Accessed on Feb. 25, 2015, 2 pages.

"Textured Leggings", Gobellygowear.com, Available on Internet a: <http://shop.gobellygowear.com/TexturedLeggingsTEXTURE.htm>, Accessed on Feb. 25, 2015, 2 pages.

Office Action received for Canadian Patent Application No. 2985616, dated May 27, 2021, 4 pages.

Office Action received for Canadian Patent Application No. 2986586, dated May 19, 2021, 5 pages.

Office Action received for Canadian Patent Application No. 2986589, dated May 28, 2021, 4 pages.

(56) References Cited

OTHER PUBLICATIONS

Intention to Grant received for European Patent Application No. 20178086.3, dated Nov. 17, 2021, 6 pages.
Intention to Grant received for European Patent Application No. 16723623.1, dated Nov. 16, 2020, 8 pages.

* cited by examiner

TRAINING TIGHT WITH PRECONFIGURED COMPRESSION ZONES AND INTEGRATED STRUCTURE PATTERNS

CROSS-REFERENCE TO RELATED APPLICATIONS

This application having entitled "Training Tight with Preconfigured Compression Zones and Integrated Structure Patterns," is continuation application of U.S. application Ser. No. 16/286,155, filed Feb. 26, 2019, and entitled "Training Tight with Preconfigured Compression Zones and Integrated Structure Patterns," which is a continuation application of U.S. application Ser. No. 15/151,924, filed May 11, 2016, entitled "Training Tight with Preconfigured Compression Zones and Integrated Structure Patterns," and issued on Apr. 23, 2019 as U.S. Pat. No. 10,265,564, which claims the benefit of priority of U.S. Prov. App. No. 62/165,478, entitled "Training Tight with Preconfigured Compression Zones and Integrated Structure Patterns," and filed May 22, 2015. The entireties of the aforementioned applications are incorporated by reference herein.

FIELD

The present disclosure relates to a training tight having preconfigured compression zones.

BACKGROUND

Effective training for athletic activities often requires engagement of the abdominal muscles. A common term for this process is "activating the core." An activated core helps to stabilize the athlete's spine and lower torso. This stabilization is enhanced by well-developed muscles in the thigh area. A poorly stabilized core can lead to back injuries, poor posture, and improper body mechanics. For most professional athletes, core activation is a natural by-product of their training. However, for the non-professional athlete, core activation poses more of a challenge. Traditional training apparel often fails to meet this challenge as its focus tends to be more on comfort, breathability, and the like.

BRIEF DESCRIPTION OF THE DRAWINGS

Examples of the present invention are described in detail below with reference to the attached drawing figures, wherein.

DETAILED DESCRIPTION

Figure 2:
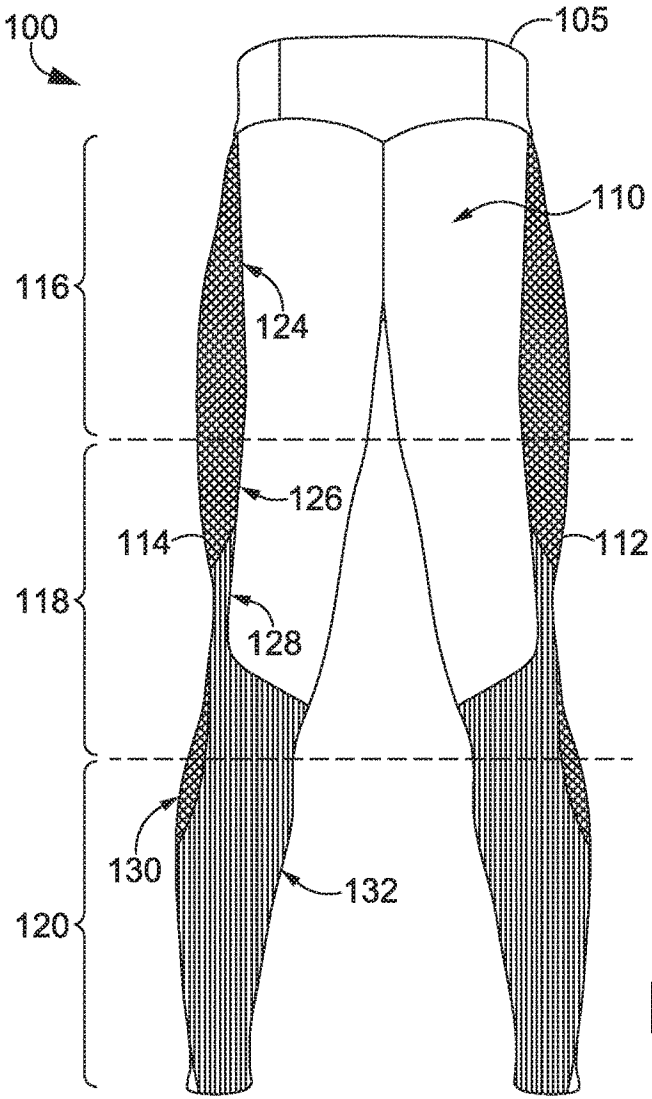
FIG. 2 illustrates a back view of the exemplary training tight with preconfigured compression zones and integrated structure patterns of FIG. 1 in accordance with an aspect herein.

The subject matter of the present invention is described with specificity herein to meet statutory requirements. However, the description itself is not intended to limit the scope of this disclosure. Rather, the inventors have contemplated that the claimed or disclosed subject matter might also be embodied in other ways, to include different steps or combinations of steps similar to the ones described in this document, in conjunction with other present or future technologies. Moreover, although the terms "step" and/or "block" might be used herein to connote different elements of methods employed, the terms should not be interpreted as implying any particular order among or between various steps herein disclosed unless and except when the order of individual steps is explicitly stated.

At a high level, aspects herein are directed toward a warp knit training tight having preconfigured compression zones with different compressive properties. The different compressive properties of the zones are achieved by varying the modulus of elasticity of the yarns used to form the zones, and/or by varying the modulus of elasticity of the fabric through yarn placement, and/or by using integrated knit structure patterns that modify the compressive properties of the zones in areas where the patterns are located. The training tights are configured such that a relatively high amount of compression is distributed over the lower torso and thigh area of a wearer and a relatively low amount of compression is distributed over the knee and calf area of the wearer when the training tight is worn. The amount of compression applied to a localized area on the wearer may be fine-tuned through use of the integrated knit structure patterns. These patterns generally comprise a plurality of offset areas created by shortening the length of the stitch used in this area. By shortening the stitch length, the modulus in the offset area is increased. The result of the configuration described is that core activation is enhanced while a high degree of mobility is maintained in the knee and ankle area of the training tight.

Aspects herein may further relate to a method of manufacturing a training tight. The method may comprise, for example, preparing a warp knitting machine (single or double bar Jacquard) to utilize different elastic yarns having different moduli of elasticity in the warp where the yarns having different moduli of elasticity correspond to the different zones discussed above. Continuing, the method may further comprise programming the warp knitting machine based on a preconfigured placement pattern of the integrated knit structures. Next, a fabric is warp knitted and one or more pattern pieces are cut from the fabric. The pattern pieces are then affixed together to form the training tight. Additional steps may comprise dyeing and finishing the tight. In aspects, the dyeing and finishing steps may occur prior to cutting and affixing the pattern pieces together. Tights formed through this type of warp knitting process exhibit four-way stretch allowing them to closely conform to the wearer's body when worn. Moreover, materials used to form the tights are selected to provide breathability, moisture-management properties, and opacity to the tight.

Accordingly, aspects herein are directed to a training tight comprising a plurality of compression zones, where each of the plurality of compression zones has a modulus of elasticity value within a predefined range, and where one or more of the plurality of compression zones has an integrated structure pattern that modifies the modulus of elasticity value of the respective compression zone.

In another aspect, aspects herein are directed to a training tight comprising a first compression zone having a first modulus of elasticity value within a predefined range, where the first compression zone is located at an upper portion of the training tight. The training tight further comprises a second compression zone having a second modulus of elasticity value within a predefined range, where the second compression zone is located adjacent to and below the first compression zone. The training tight also comprises a third compression zone having a third modulus of elasticity value within a predefined range, where the third compression zone is located adjacent to and below the second compression zone. In aspects, one or more of the first, second, and third compression zones comprises one or more integrated structure patterns that modify the modulus of elasticity value of the respective compression zone.

In yet another aspect, a method of forming a training tight is provided comprising preparing a fabric. Preparing the fabric comprises knitting a first compression zone having a first modulus of elasticity and a first integrated knit structure pattern; knitting a second compression zone adjacent to the first compression zone, where the second compression zone has a second modulus of elasticity and a second integrated knit structure pattern; and knitting a third compression zone adjacent to the second compression zone, where the third compression zone has a third modulus of elasticity and a third integrated knit structure pattern. The method further comprises cutting one or more pattern pieces from the fabric and affixing the one or more pattern pieces together at one or more seams to form the training tight.

As used throughout this disclosure, the term "elastic yarn" is meant to encompass both natural and synthetic yarns, fibers, and/or filaments that have the ability to be stretched and to return to their original form. Exemplary elastic yarns, fibers, and/or filaments include Lycra, thermoplastic polyurethane (TPU), elastane, rubber, latex, spandex, combinations thereof, and the like. The elastic yarns may be used by themselves to form the tights, or they may be combined with other types of yarns or fibers such as cotton, nylon, rayon, wool, polyester, or other fiber types to form the tights. In one exemplary aspect, these non-elastic yarns may comprise 50 denier polyester yarns. Further, as used throughout this disclosure, the term "modulus of elasticity" may be defined as a measure of an object's resistance to being deformed elastically when a force is applied to it. Modulus values, as described herein, are measured at 30% stretch across the width of the tight by ASTM D4964 and are expressed in pound-force (lbf). The term "compression force" as used herein is a measure of the pushing or pressing force that is directed toward the center of an object. The compression force is measured by a Salzmann Device and is expressed as a surface pressure value in mmHg.

Further, as used throughout this disclosure, the term "tight" may be defined as an article of clothing that closely conforms to the body contours of a wearer. This may be achieved by, for instance, incorporating elastic yarns into the tight as explained above. The term tight may refer to a full legging, a capri-style tight, a half-tight, a three-quarter tight, or a pair of shorts. In exemplary aspects, the tight may comprise a base layer worn under other layers of clothing. However, it is also contemplated herein that the tight may be worn by itself (i.e., not covered by other layers).

Figure 1:
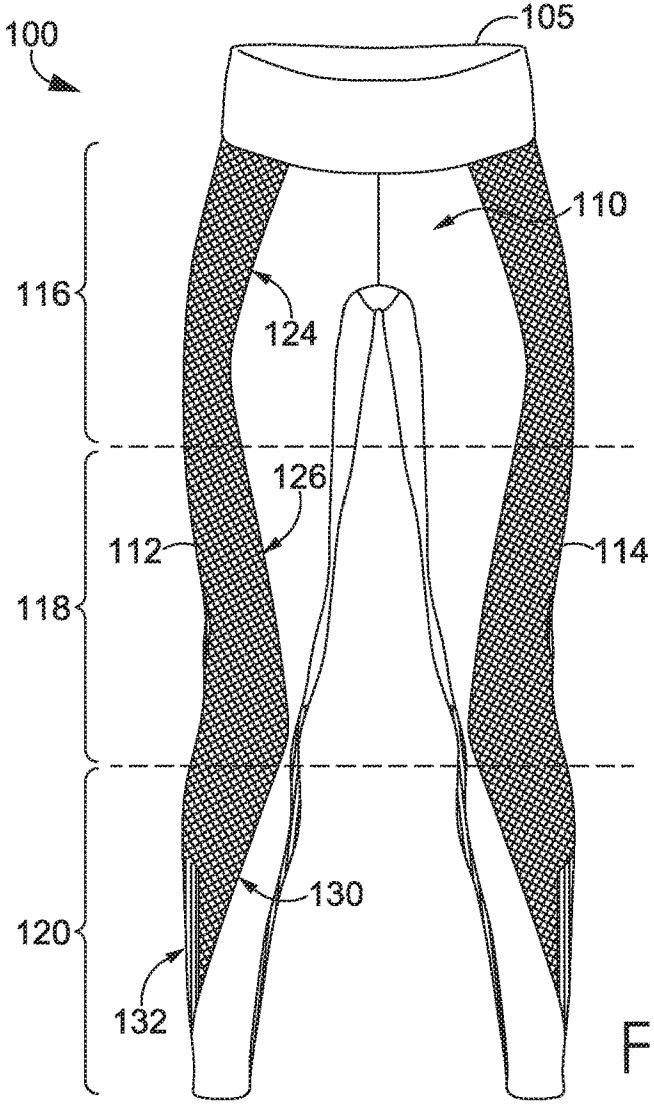
FIG. 1 illustrates a front view of an exemplary training tight with preconfigured compression zones and integrated structure patterns in accordance with an aspect herein.

Turning now to FIG. 1, a front view of an exemplary training tight 100 having compression zones and integrated knit structure patterns is depicted in accordance with an aspect herein. In exemplary aspects, the training tight 100 may be formed from a textile or panel knitted using a single bar Jacquard warp knitting process. The training tight 100 may comprise an optional waistband 105 affixed to a lower torso portion 110 of the tight 100, where the lower torso portion 110 is adapted to cover a lower torso of a wearer when the tight 100 is worn. The training tight 100 may further comprise a first leg portion 112 and a second leg portion 114 adapted to cover the legs of the wearer when the tight 100 is worn. Although shown as a full legging, it is contemplated that the training tight 100 may be in the form of a capri-type style, a half-tight, a three-quarter tight, or a short.

In exemplary aspects, the tight 100 may be divided into three compression zones, 116, 118, and 120 where at least two or more of the compression zones may exhibit different compressive properties. In exemplary aspects, the three compression zones 116, 118, and 120 may be in a generally horizontal orientation on the tight 100 due to the single bar Jacquard warp knitting process. It is contemplated that the training tight may include more or less than three compression zones. The use of the term "compression zone" is meant to convey the functional characteristics of a particular area of the tight 100 and is not meant to imply a specific shape, size, color, pattern, or orientation. For example, the training tight 100 may visually appear to have a generally uniform surface with no clear demarcation between the different zones.

The different compressive properties of the compression zones 116, 118, and 120 may be created by, for example, using elastic yarns of differing diameter or differing denier in the warp. Elastic yarns having a higher denier or larger diameter will generally have a higher modulus of elasticity as compared to yarns having a smaller denier or a smaller diameter. Elastic yarns contemplated herein may have deniers ranging from, for example, 20 denier up to 160 denier. In an exemplary aspect, the compressive property of a particular zone may be created by using elastic yarns all having the same denier. For instance, 40 denier yarns may be used to knit a compression zone having a generally low modulus of elasticity, while 70 denier yarns may be used to knit a compression zone having a generally medium modulus of elasticity. In another exemplary aspect, the compressive property of a zone may be created by combining elastic yarns having different deniers. As an example, 40 denier yarns may be used with 70 denier yarns (for a combined denier of 110) to knit a compression zone having a generally high modulus of elasticity. Other combinations of deniers are contemplated herein. For instance, for compression zones having a generally medium to high compression force or modulus of elasticity, other combinations may comprise 20 denier yarns with 60 denier yarns for a combined denier of 80, 30 denier yarns with 50 denier yarns for a combined denier of 80, 40 denier yarns with 40 denier yarns for a combined denier of 80, and the like. Any and all such aspects, and any variation thereof, are contemplated as being within the scope herein.

In exemplary aspects, the first zone 116 generally extends from an upper margin of the tight 100 to above the knee area of the leg portions 112 and 114 (approximately one-third the length of the tight 100 as measured from the upper margin). In exemplary aspects, the first zone 116 may be constructed to have a modulus of elasticity in the range of 0.75 to 2.0 lbf, or 0.93 to 1.72 lbf. The compression force associated with the first zone 116 may be in the range of 15 to 25 mmHg. By distributing a high amount of compression force over the front and back sides of the wearer's lower torso and thigh area, the wearer may be assisted in activating his or her core.

In exemplary aspects, the first zone 116 may have a first integrated structure pattern comprising a series of shapes 124 in the form of diamonds. As mentioned, the compression force and/or modulus associated with a particular compression zone, such as the first zone 116, may be modified by use of knit structure patterns that are integrally formed from the same yarns used to knit the compression zones. The knit structure pattern generally comprises a pattern of offset, depressed areas in the fabric (areas of the fabric that extend inwardly away from the outer-facing surface plane of the tight 100). In exemplary aspects, these offset, depressed areas surround and define different structures or shapes. For example, the structures may comprise a series of lines created when the offset, depressed areas define a plurality of lines. In another example, a shape pattern may be created when the offset, depressed areas define a plurality of geometric shapes such as diamonds, squares, chevrons, and the like. In some exemplary aspects, the offset, depressed areas themselves may form shapes such as circles, diamonds, square, and the like, and the remaining portions of the tight surrounds these offset shapes. Any and all such aspects, and any variation thereof, are contemplated as being within the scope herein.

The integrated knit structure patterns are created by, for instance, changing the length of the knit stitches. For example, a shorter stitch may be used to knit the offset, depressed areas of the pattern. Because a shorter stitch is used, these depressed areas typically exhibit less stretch due to less yarn and/or shorter floats in the stitch. And because these areas exhibit less stretch, the modulus of elasticity and/or compression force associated with these offset areas is increased. Thus, in general, the modulus of elasticity or compression force associated with the knit structure patterns is greater than the modulus of elasticity in the areas where the knit structure patterns are not located.

Figure 4:
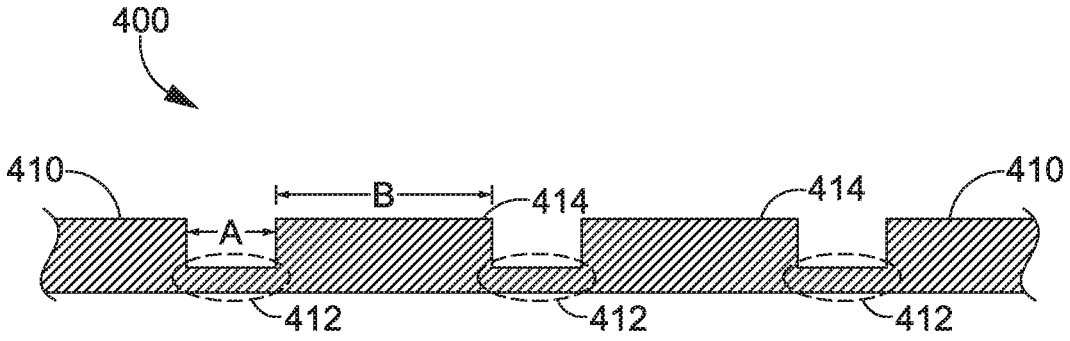
FIG. 4 illustrates a cross-section of an exemplary training tight taken at the location of an integrated structure pattern in accordance with an aspect herein.

A depiction of a cross-section of a fabric having an integrated knit structure pattern, referenced generally by the numeral 400, is illustrated in FIG. 4 in accordance with an aspect herein. In exemplary aspects, the fabric having the integrated knit structure pattern 400 may be incorporated into a tight, such as the training tight 100. As such, the reference numeral 410 indicates the portion of the tight on either side of or surrounding the integrated knit structure pattern 400. The offset, depressed areas created by using the shorter length stitch are indicated by the reference numeral 412. As shown, the areas 412 are offset from or extend inwardly from the outer-facing surface plane of the tight and have a width "A." In exemplary aspects, the width A of the offset areas 412 may range from 0.5 mm up to 10 mm. In exemplary aspects, the offset areas 412 may delineate, space apart, and/or define a set of structures 414 having a width "B." The width B of the structures 414 may range from 0.5 mm up to 10 mm. The structures 414 are knit with generally the same stitch length as portions of the tight that do not have integrated structure patterns. As such, the "height" of the structures 414 generally align with the outer-facing surface plane of the tights. To put it another way, the structures 414 generally do not extend past the outer-facing surface plane of the tights. Depending on the pattern of the offset areas 412, the structures 414 may comprise lines or shapes such as those described with respect to FIGS. 5A-5S below. In another exemplary aspect, the offset areas 412 may themselves have a defined shape such as a circle, square, diamond, and the like. In this aspect, the non-offset areas of the tight surround and help to define these offset shapes. Any and all such aspects, and any variation thereof, are contemplated as being within the scope herein.

As described, the modulus of elasticity or compression force associated with a particular compression zone may be increased by use of integrated knit structure patterns such as the integrated knit structure pattern 400. The amount of increase may be tailored or customized by increasing and/or decreasing the percentage, surface area, or amount of the offset, depressed areas, such as the offset areas 412 of FIG. 4, in the particular knit structure pattern. As an example, by increasing the amount, percentage, or surface area of offset, depressed areas in a particular knit structure pattern, the compression force and/or modulus of elasticity in the knit structure pattern may be further increased. To describe it in a different way, the compression force and/or modulus of elasticity in a particular knit structure pattern may be further increased by increasing the spacing between adjacent structures in the pattern since the spacing corresponds to the offset areas (e.g., the spacing corresponds to the width A in FIG. 4). Conversely, by decreasing the amount, percentage, or surface area of offset, depressed areas in a particular knit structure pattern, the compression force and/or modulus associated with the knit structure pattern may be decreased relative to those areas of the pattern that have a higher percentage of offset areas. To put it another way, the compression force and/or modulus of elasticity in a particular knit structure pattern may be relatively decreased by decreasing the spacing between adjacent structures in the pattern.

Continuing, the orientation and/or direction of the offset areas within a particular knit structure pattern in relation to the tight as a whole may be used to modify the direction of the compression force and/or modulus of elasticity associated with the pattern. As an example, when the offset areas are in the form of lines, by orienting the offset lines in a generally vertical direction on the tight, the modulus associated with the pattern may be modified in a first vertical direction but be generally unmodified in a horizontal direction. However, by orienting the offset lines in the pattern in a generally horizontal direction, the modulus associated with the pattern may be modified in a second horizontal direction but be unmodified in the vertical direction. Any and all such aspects, and any variation thereof, are contemplated as being within aspects herein.

Figure 5A:
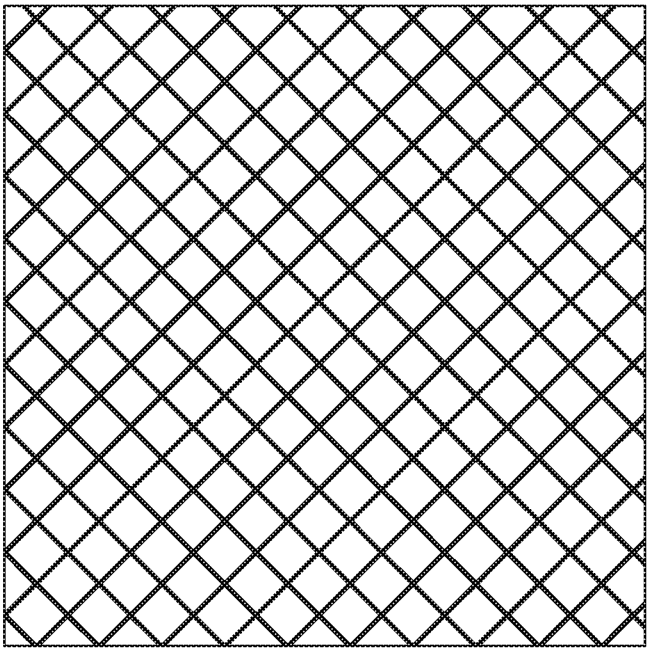
FIGS. 5A-5S illustrate exemplary configurations and exemplary spacings for the integrated structure patterns in accordance with aspects herein.
Figure 5B:
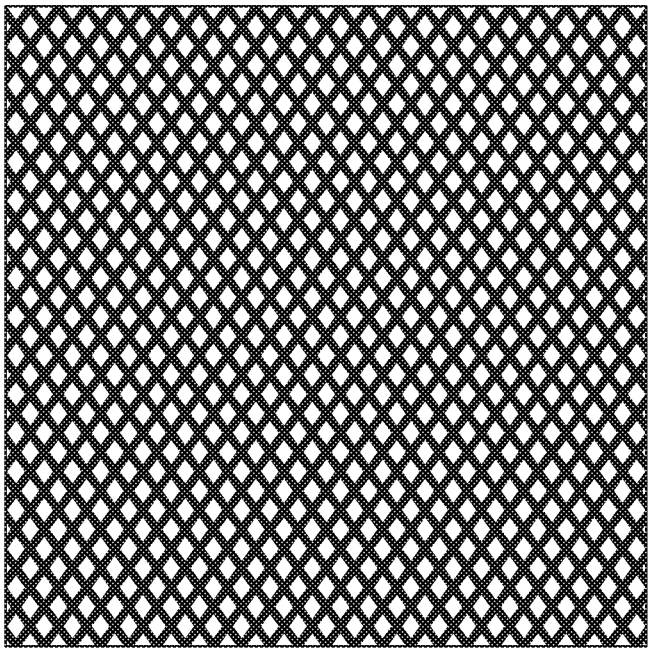
Figure 5C:
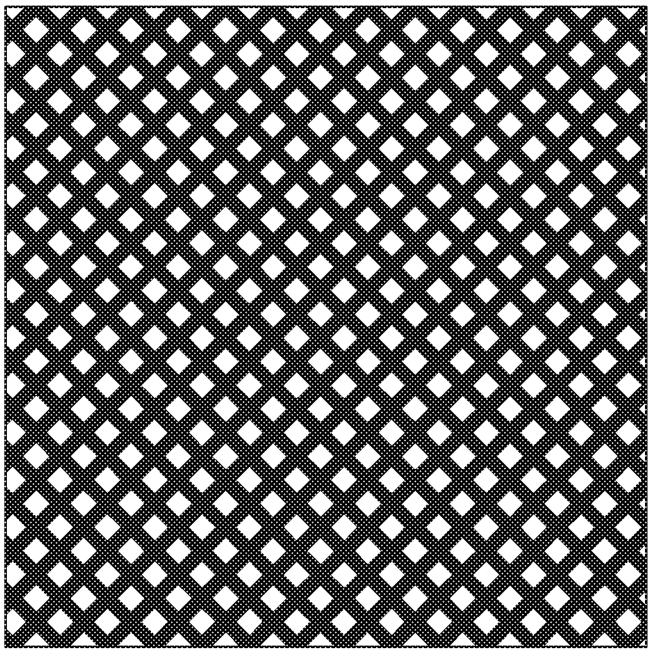
Figure 5D:
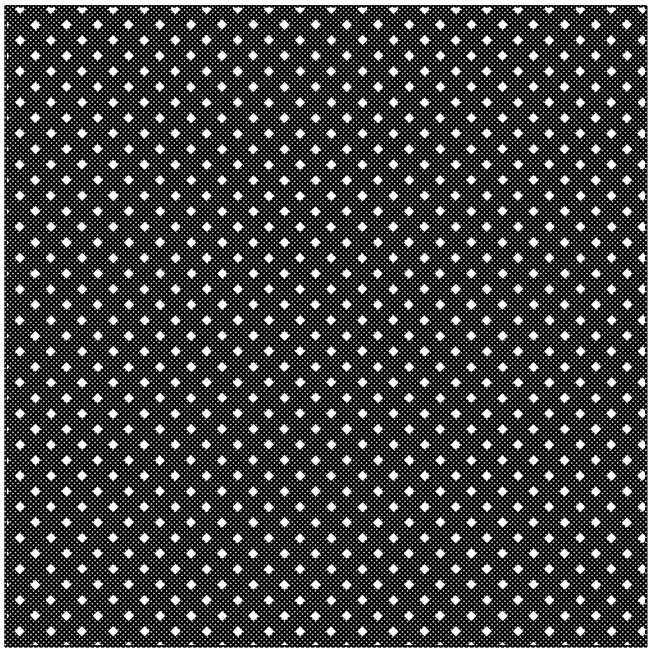
Figure 5E:
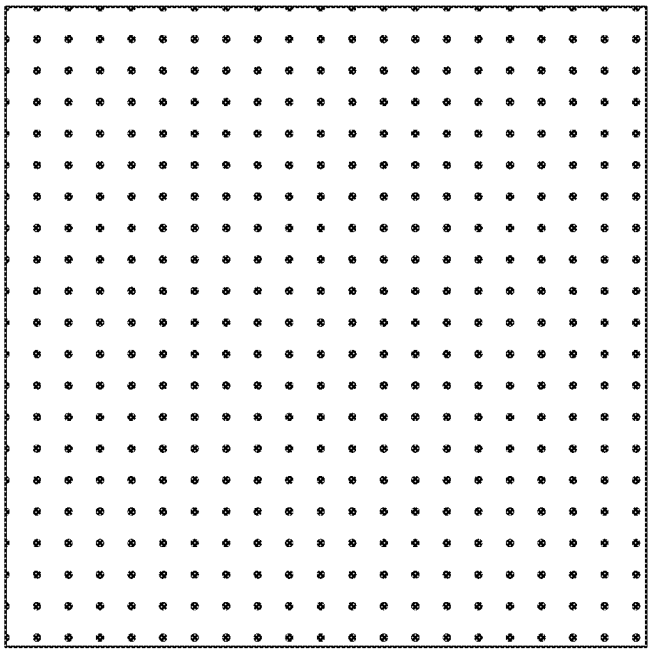
Figure 5F:
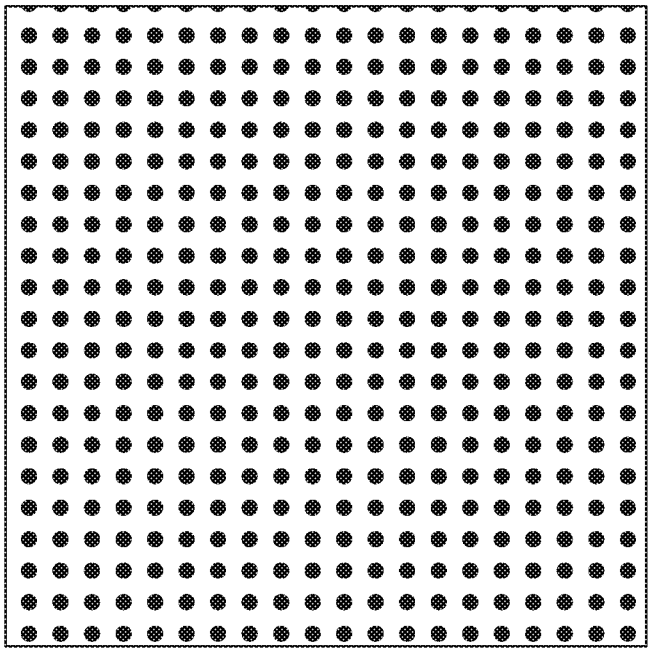
Figure 5G:
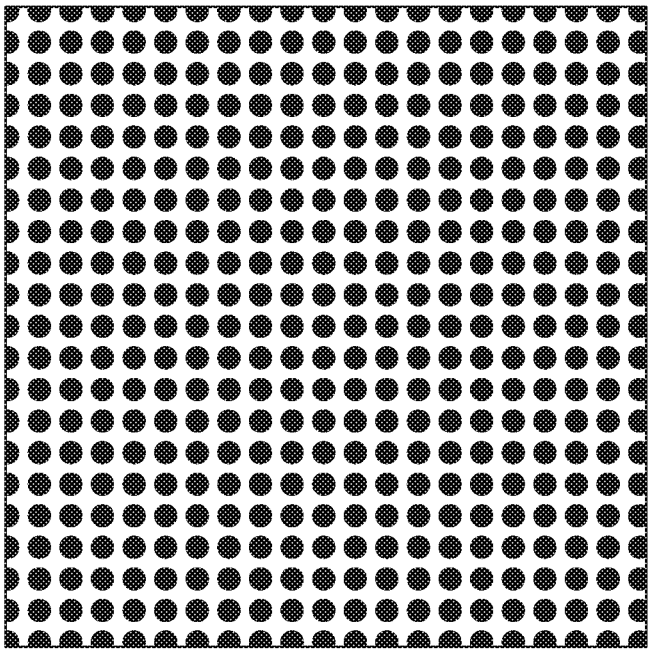
Figure 5H:
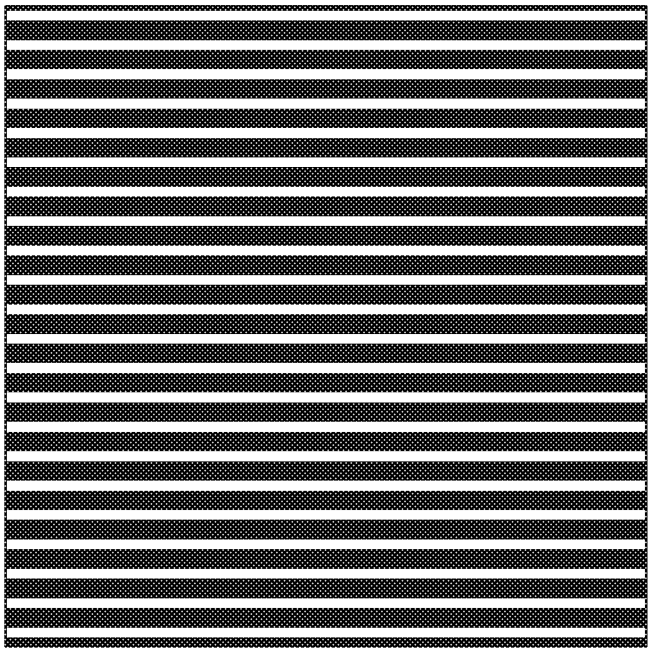
Figure 5I:
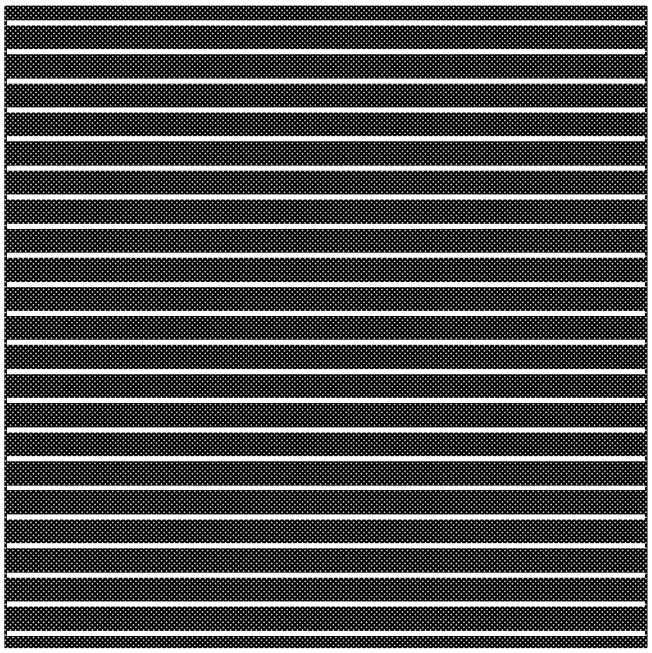
Figure 5J:
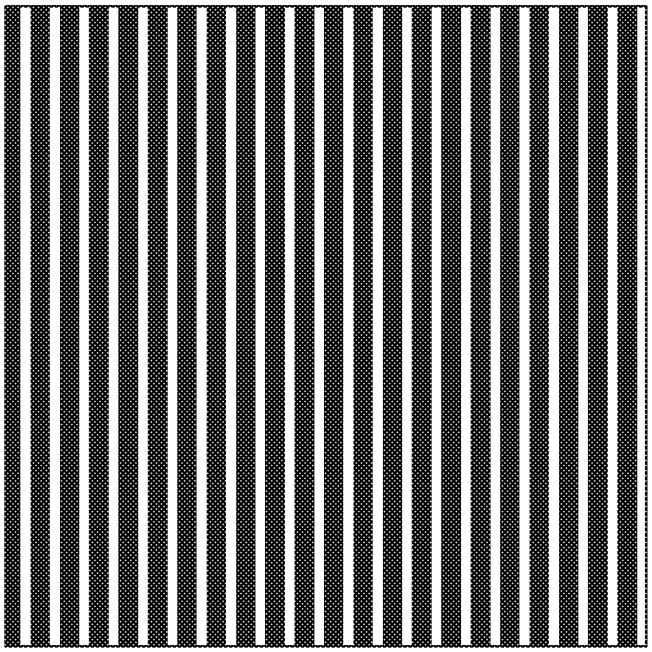
Figure 5K:
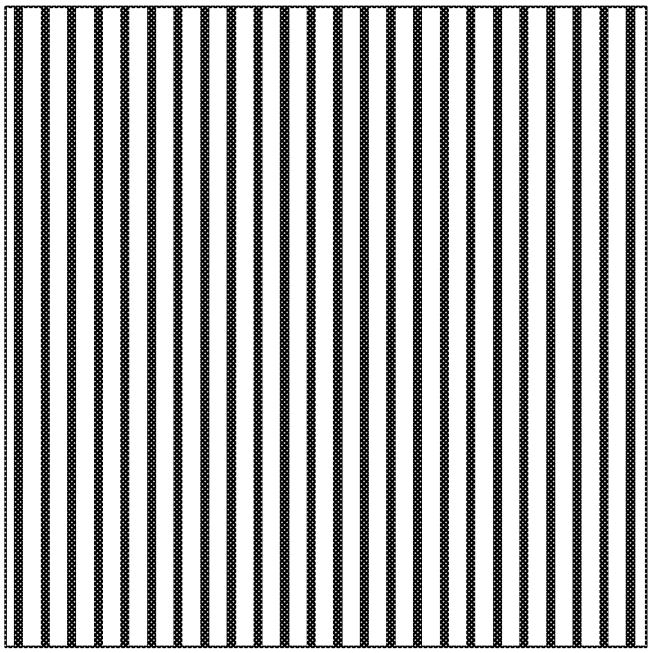
Figure 5L:
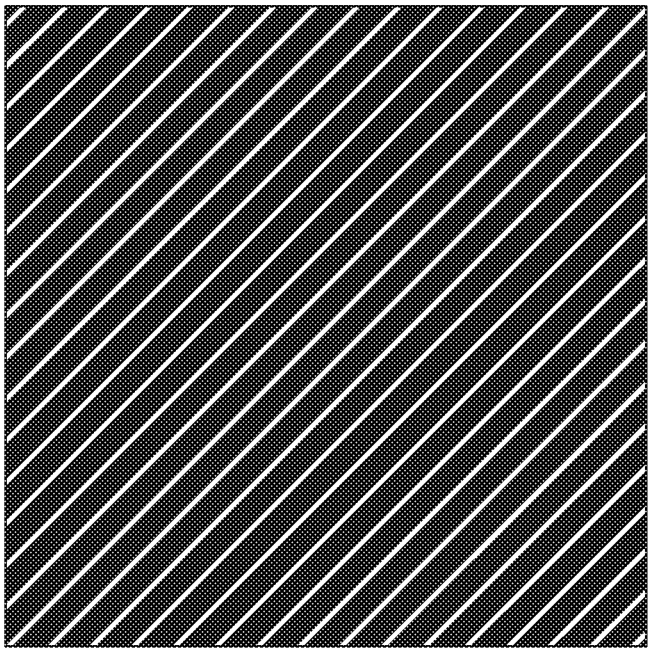
Figure 5M:
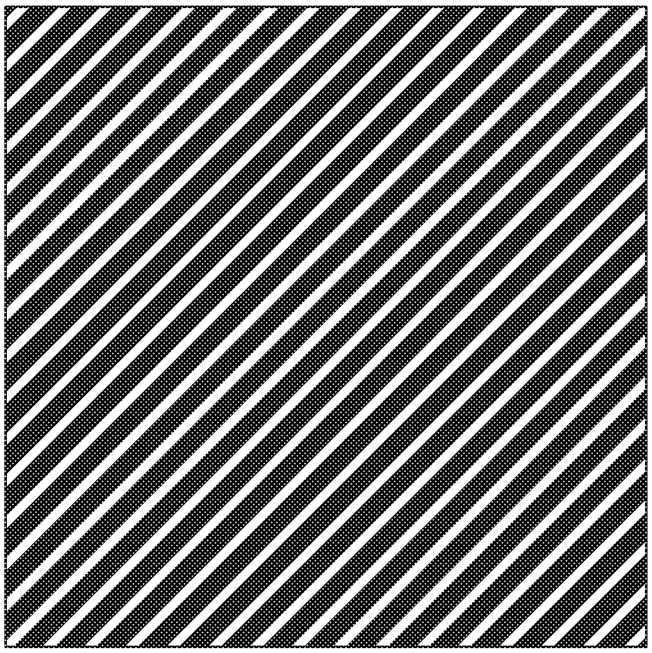
Figure 5N:
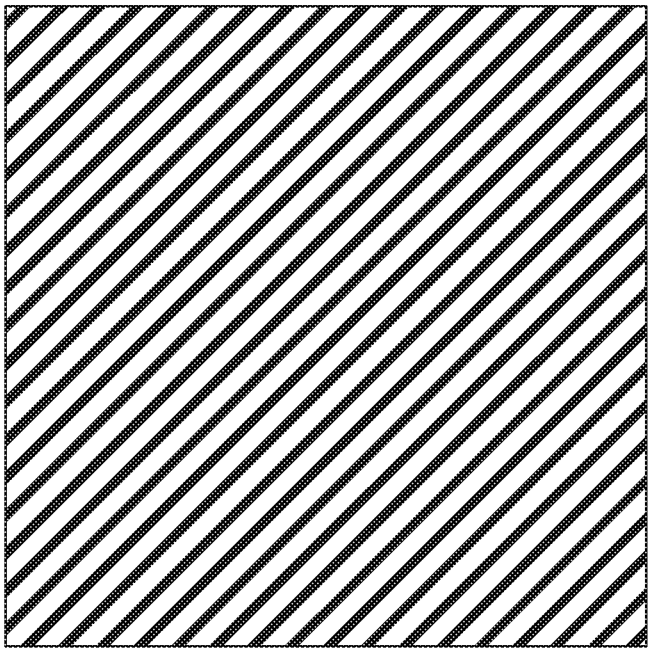
Figure 5O:
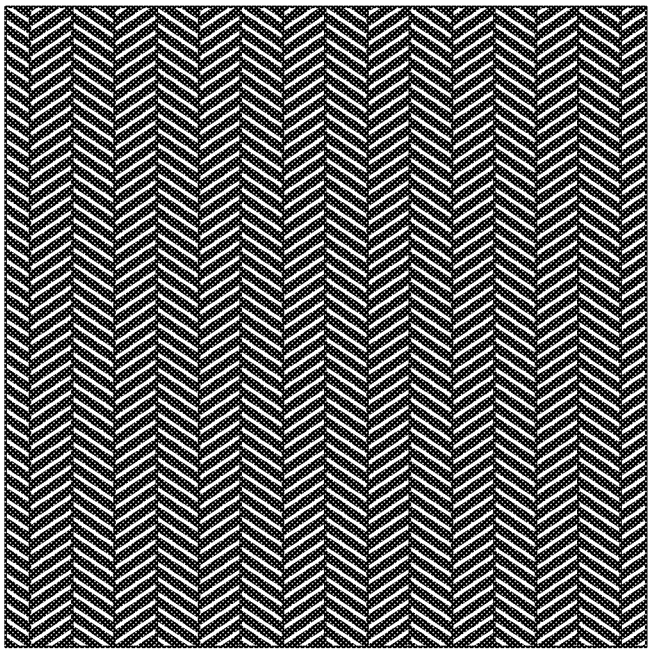
Figure 5P:
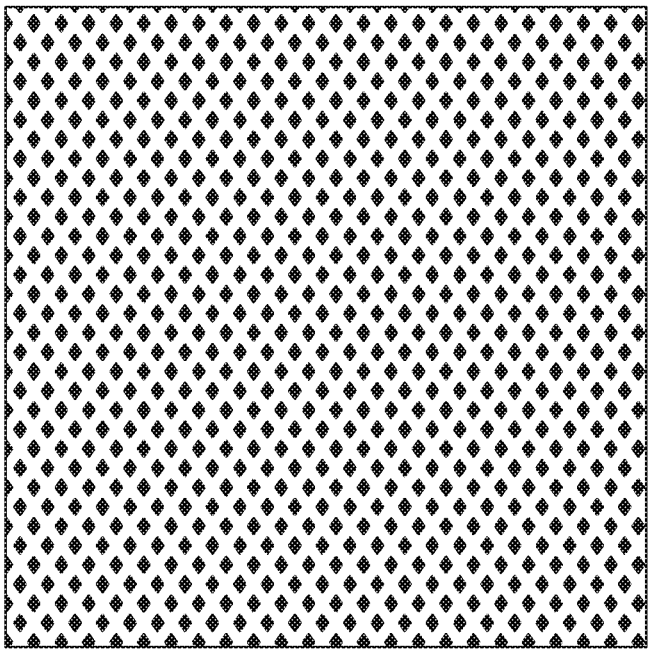
Figure 5Q:
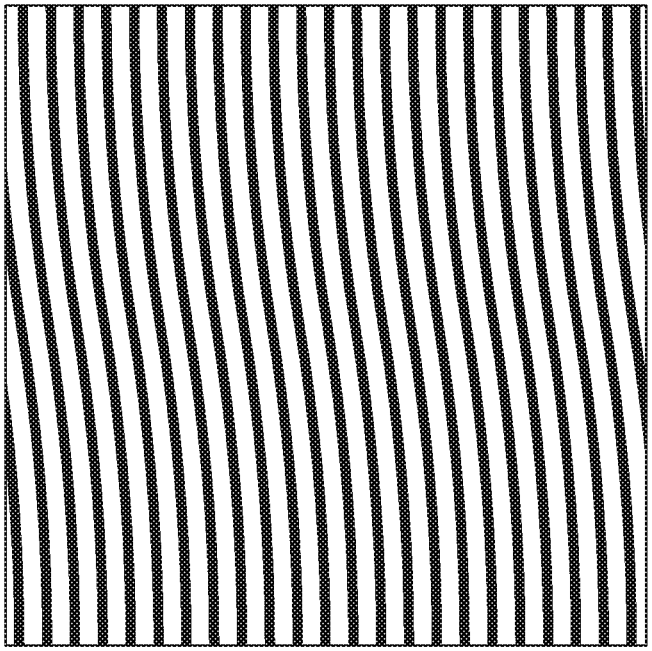
Figure 5R:
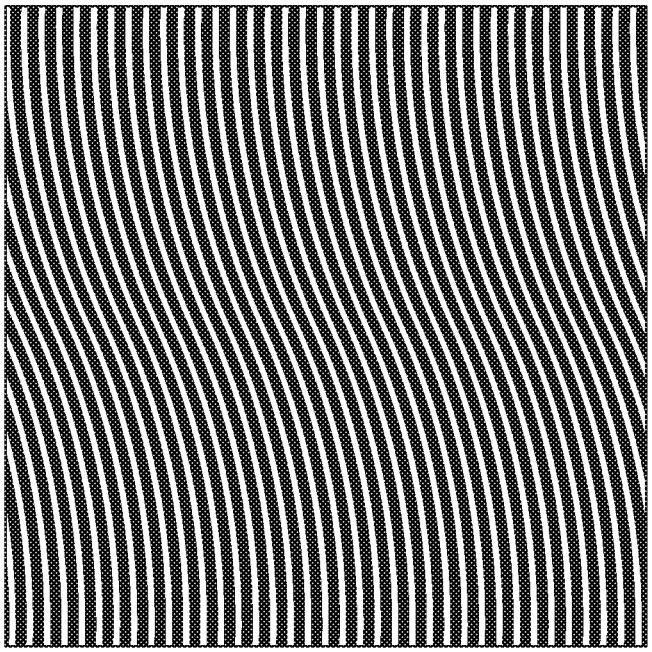
Figure 5S:
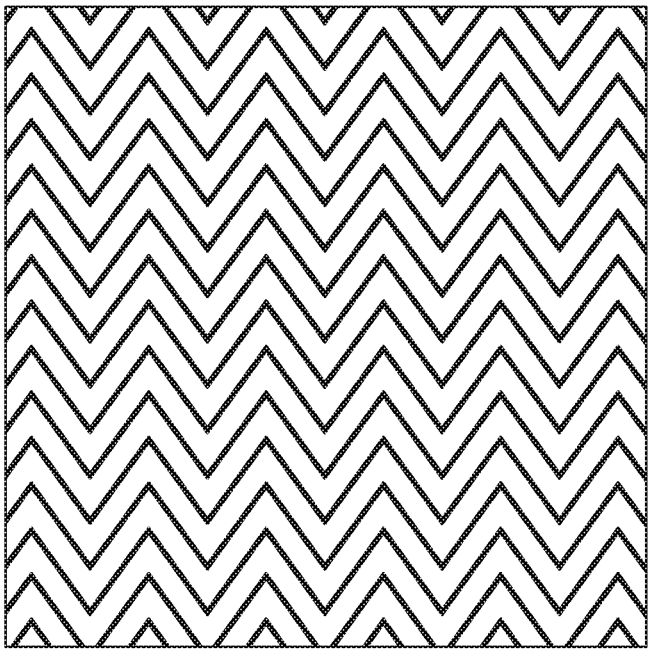

FIGS. 5A-5S illustrate a number of examples of integrated structure patterns as contemplated herein. The offset areas are shown in black and the structures defined by the offset areas are shown in white. For instance, FIGS. 5A-5D depict a series of diamond structures, where the spacing (e.g., the offset areas) between the diamonds gradually increases from FIG. 5A to FIG. 5D with a resultant decrease in size of the diamonds from FIG. 5A to FIG. 5D. Thus, the modulus and/or compression force associated with this pattern would increase from FIG. 5A to FIG. 5D.

FIGS. 5E-5G depict examples where the offset areas are in the form of circles and the remaining portion of the tight surrounds the circles. The size of the circles gradually increases from FIG. 5E to FIG. 5G, which would cause a corresponding increase in the modulus and/or compression force from FIG. 5E to FIG. 5G. Although circles are shown, it is contemplated herein that the offset areas may take other forms such as square, diamonds, triangles, and the like. FIGS. 5H and 51 depict a series of horizontal line structures, where the offset spacing between the lines increases from FIG. 5H to FIG. 5I with a resultant decrease in the width of the lines from FIG. 5H to FIG. 5I. Because the offset spacing in these patterns is oriented along a horizontal axis, the modulus and/or compression force would be increased along this axis.

Continuing, FIGS. 5J and 5K depict a series of vertical line structures, where the spacing between the lines decreases from FIG. 5J to FIG. 5K with a resultant increase in the width of the lines between these two figures. FIGS. 5L-5N depict a series of diagonal line structures, where the spacing between the lines decreases from FIG. 5L to FIG. 5N with a resultant increase in the width of the lines from FIG. 5L to FIG. 5N. FIG. 5O depicts a series of diagonal line structures oriented in different directions, and FIG. 5P depicts a configuration where the offset areas form diamond shapes. FIGS. 5Q-5R depict a set of curvilinear line structures separated by offset areas, where the spacing increases from FIG. 5Q to FIG. 5R with a resultant decrease in the size of the lines from FIG. 5Q to FIG. 5R. FIG. 5S depicts a series of zig-zag line structures separated by zig-zag offset spaces. Although not shown, the spacing between the zig-zag line structures may be increased or decreased with a resultant decrease or increase of the width of the zig-zag lines respectively.

As seen, the integrated knit structure patterns may take a variety of forms in order to achieve different functional purposes as outlined above. For example, by increasing the spacing between the structures (i.e., by increasing the percentage or surface area of the offset areas), a higher modulus and/or compression is achieved in the area of the tight where the pattern is located, and by decreasing the spacing between the structures (i.e., by decreasing the percentage or surface area of the offset areas), the modulus and/or compression force is reduced relative to areas of the pattern having increased spacing. Moreover, by orienting the pattern in certain directions, the modulus of elasticity may be altered along a long axis of the pattern. Using FIG. 5L as an example, by orienting the lines and offset areas along a diagonal axis, the modulus along that diagonal axis may also be increased. Although shown as diamonds, it is contemplated herein that any of the other configurations described above may be used. Any and all such aspects, and any variation thereof, are contemplated as being within the scope herein.

Returning now to FIG. 1, the shapes 124 (shown in the form of diamonds) are defined by and separated from each other by offset, depressed areas having a shorter stitch and higher modulus (described above). Although shown as diamonds, it is contemplated that any of the other configurations described above may be used. The shapes 124 may be generally located near the lateral margins of the training tight 100 and may extend around to the back or posterior side of the tight 100 as will be shown in FIG. 2. As described earlier, the use of the shapes 124 may increase the modulus of elasticity and/or compression force in the underlying area of the tight 100 in which the shapes 124 are located as compared to areas of the tight 100 that do not have an integrated structure pattern. In exemplary aspects, the modulus of elasticity and/or compression force may be increased in this area by, for example, 2%, 5%, 10%, 20%, 30%, 40%, up to 50%, or any value in between.

The spacing between the shapes 124 may be adjusted along a gradient to gradually modify the modulus along the gradient. With reference to FIG. 1, the shapes 124 may be spaced closer together at the upper or superior portion of the first zone 116 and may gradually become more widely spaced towards the lower or inferior portion of the first zone 116. This variation in spacing is shown in greater detail in FIG. 3A. The spacing gradient between the shapes 124 may cause the modulus of elasticity and/or compression force to be further increased along the gradient by, for example, 1%, 2%, 5%, 7%, 10% up to 15% or any value in between with the larger increases being associated with the greater spacing. By locating the shapes 124 along the lateral margins of the tights 100, and by creating the modulus gradient as described, an even greater compression force may be applied along the length of the wearer's iliotibial (IT) band when the tight 100 is worn which may help to further activate the wearer's core. The location and spacing associated with the shapes 124 are exemplary only, and it is contemplated that other locations and other spacing gradients may be utilized in association with the tight 100. Moreover, it is contemplated herein that the first zone 116 may not comprise an integrated structure pattern. Any and all aspects, and any variation thereof, are contemplated as being within the scope herein.

Continuing, the second zone 118 generally extends from the lower margin of the first zone 116 to an area slightly below or inferior to the knee area of the tight 100. In exemplary aspects, the second zone 118 may be constructed to have a modulus of elasticity in the range of 0.05 to 0.75 lbf, or 0.07 to 0.51 lbf. The compression force associated with the second zone 118 may be in the range of 10 to 20 mmHg.

In exemplary aspects, the second zone 118 may have an integrated structure pattern in the form of a set of shapes 126 and a set of parallel lines 128. The lines 128 may be generally positioned on the back-facing side (posterior side) of the tight 100 and will be described with respect to FIG. 2. The shapes 126 may comprise an extension of the shapes 124 associated with the first zone 116. The shapes 126 may be positioned such that they gradually extend from the lateral margin of the tight 100 to overlie the front-facing (anterior) surface of the tight 100 moving from the upper portion of the zone 118 to the lower portion of the zone 118. The shapes 126 may extend towards the medial margin of the tight 100 at the lower portion of the second compression zone 118. In exemplary aspects, spacing between the shapes 126 may be along a gradient with increased spacing between the shapes 126 located closer to the lower or inferior portion of the second zone 118. The location and spacing associated with the shapes 126 are exemplary only, and it is contemplated that other locations and other spacing gradients may be utilized in association with the tight 100. Moreover, it is contemplated herein that the second zone 118 may not comprise an integrated knit structure pattern. Any and all aspects, and any variation thereof, are contemplated as being within the scope herein.

By configuring the second zone 118 to have a compression force and/or modulus of elasticity that is less than the compression force and/or modulus of elasticity of the first zone 116, a greater degree of mobility is imparted over the knee area of the tight 100. In exemplary aspects, the modulus of the second zone 118 may be modified through use of the shapes 126 to increase the amount of compression over, for instance, the wearer's quadriceps when the tight 100 is worn.

In exemplary aspects, the third zone 120 may generally extend from the lower margin of the second zone 118 to the lower or bottom margin of the tight 100. In exemplary aspects, the third zone 120 may be constructed to have a modulus of elasticity between 0.01 to 0.05 lbf, or 0.02 to 0.03 lbf. The compression force associated with the third zone 120 may be less than 10 mmHg. By providing a relatively low level of compression over the shin/calf/ankle area of the tight 100, mobility in this region may be enhanced.

In exemplary aspects, the third zone 120 may have an integrated structure pattern in the form of a set of shapes 130 and a set of parallel lines 132. The lines 132 are best shown in FIG. 2 and will be described below. The shapes 130 may comprise an extension of the shapes 126 associated with the second zone 118. As such, the shapes may be generally positioned over the front or anterior portion of shin area of the tight 100 at the upper or superior portion of the third zone 120 and gradually taper towards the lateral margin of the tight 100 at the lower or inferior portion of the third zone 120. The spacing gradient between the shapes 130 in this area may be generally the same as that between the shapes 126 at the lower margin of the second zone 118. Use of the shapes 130 in this area may provide beneficial compression over the muscles along the shin. The location and spacing associated with the shapes 130 are exemplary only, and it is contemplated that other locations and other spacing gradients may be utilized in association with the tight 100. Moreover, it is contemplated herein that the third zone 120 may not comprise an integrated knit structure pattern. Any and all aspects, and any variation thereof, are contemplated as being within the scope herein.

With respect to FIG. 2, FIG. 2 illustrates a back view of the exemplary training tight 100 in accordance with aspects herein. The back view of the tight 100 comprises the same zones 116, 118, and 120 as were described in relation to FIG. 1. As such, location of the zones, the modulus of elasticity values, and the compression force values discussed in relation to FIG. 1 with respect to the zones are equally applicable here. However, the location of the integrated structure patterns on the back or posterior portion of the tight 100 differs from the location of the patterns on the front portion of the tight 100 in exemplary aspects.

In exemplary aspects, the first zone 116 on the back of the tight 100 may comprise the shapes 124 as they extend around the lateral margin of the tight 100. As such, the first zone 116 may comprise a vertical span of the shapes 124 along the lateral margin of the tights 100. Like the shapes 124 located on the front-facing side of the tight 100, spacing between the shapes 124 may gradually increase from the upper or superior portion to the lower or inferior portion of the first zone 116. The location and spacing associated with the shapes 124 on the back portion of the tight 100 are exemplary only, and it is contemplated that other locations and other spacing gradients may be utilized in association with the tight 100.

The upper portion of the second zone 118 on the back side of the tight 100 may comprise an extension of the shapes 126 located on the front-facing side of the tight 100. As such, the shapes 126 may generally occupy an area towards the lateral margin of the tight 100. In exemplary aspects, the location of the shapes 126 may generally correspond to the lower or inferior end of the wearer's IT band when the tight 100 is worn.

The lines 128 mentioned with respect to FIG. 1 may generally begin at the lateral margin of the tight 100 and gradually extend over the entirety of the posterior aspect of the second zone 118 towards the lower portion of the zone 118 such that the lines 128 are generally positioned adjacent to the upper calf area of the wearer when the tight 100 is worn. The lines 128 may be oriented in a generally vertical direction and, as such, may increase the modulus along a vertical axis. An increased modulus along the vertical axis corresponds to the generally vertical orientation of the calf muscles. In exemplary aspects, the compression force and/or modulus of elasticity may be increased by the lines 128 by, for example, 1%, 2%, 5%, 10%, 15%, 20% up to 25%, or any value in between.

The spacing between the lines 128 may be configured to further modify the modulus of elasticity and/or compression force of the underlying area. With reference to FIG. 2, the lines 128 located closer to the lateral margin of the tight 100 may be spaced further apart (e.g., more offset area) than the lines 128 located closer to the medial margin of the tight 100. In exemplary aspects, the modulus of elasticity and/or compression force may be increased along the spacing gradient by, for example, 1%, 2%, 5%, 10%, 15%, 20% up to 25%, or any value in between with the greater increases associated with the greater spacing. The location and spacing associated with the lines 128 on the back portion of the tight 100 are exemplary only, and it is contemplated that other locations and other spacing gradients may be utilized in association with the tight 100.

The third zone 120 comprises a small extension of the shapes 130 that are located on the front-facing side of the tights 100. The shapes 130 occupy an area towards the lateral margin of the tight 100 at the upper portion of the third zone 120. The remainder of the back-facing side of the third zone 120 is occupied by an extension of the lines 128 of the second zone 118 (now labelled as lines 132). Spacing between the lines 132 may be along a gradient with increased spacing in areas located near the lateral margin of the tight and decreased spacing in areas located near the medial margin of the tight 100. By locating the lines 132 on the back-facing side of the tight 100, orienting the lines 132 in a vertical direction, and by creating the spacing gradient as described, a beneficial level of compression may be provided over the vertically-oriented calf muscles. The location and spacing associated with the lines 132 on the back portion of the tight 100 are exemplary only, and it is contemplated that other locations and other spacing gradients may be utilized in association with the tight 100.

When the tight 100 is configured as a short, capri, a three-quarter tight, or as a half-tight, the positioning of the zones 116, 118 and 120 and their associated structure patterns generally remains the same. One difference, however, is that the second and/or third zones 118 and 120 may be truncated resulting in a decreased length of these zones and a corresponding loss of some of the structure patterns. For example, the lines 132 may be truncated or even eliminated when forming the capri, three-quarter tight, or half-tight.

Figure 3A:
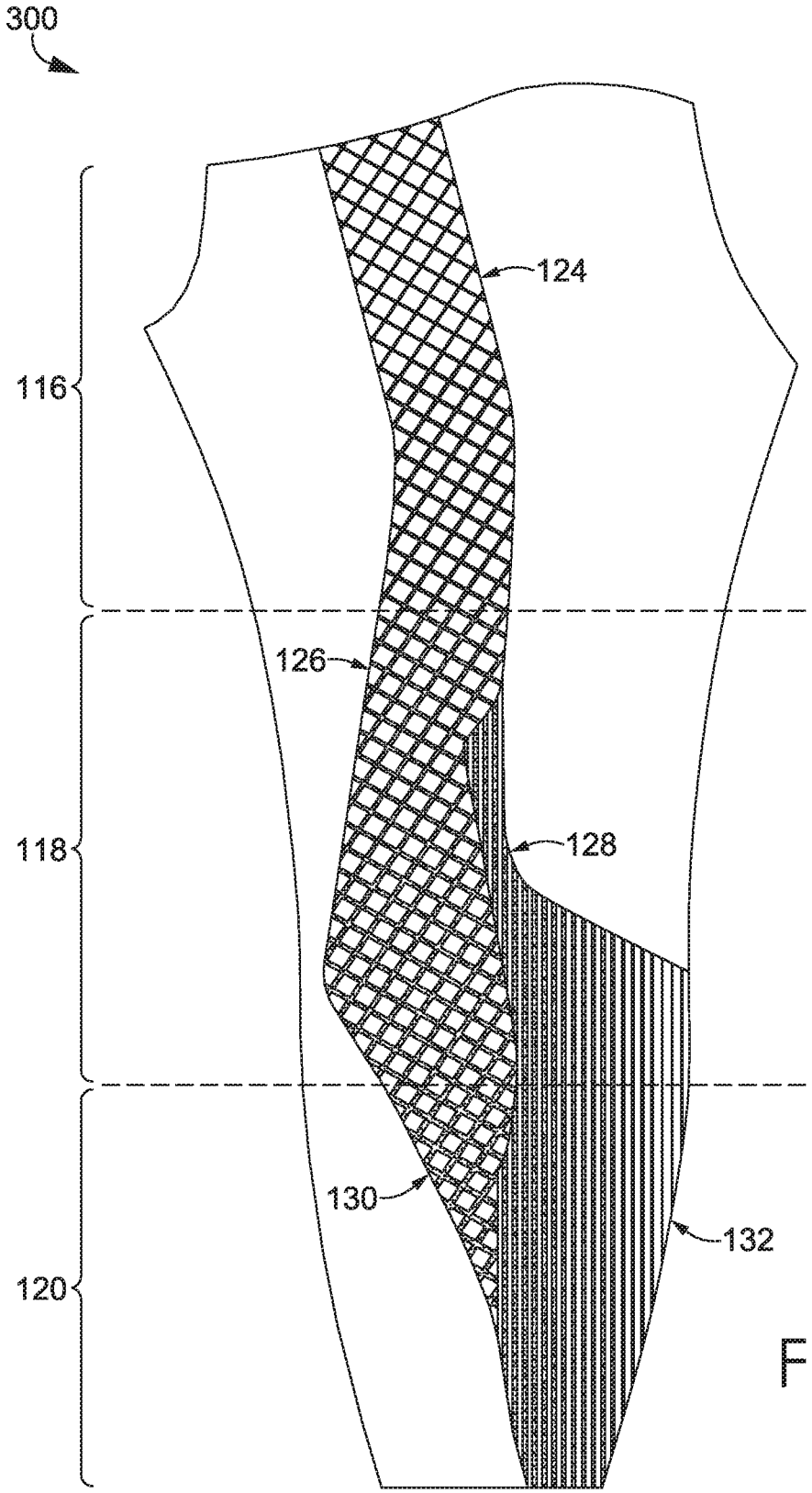
FIG. 3A illustrates a pattern piece used to construct the exemplary training tight of FIG. 1 in accordance with an aspect herein.

Turning now to FIG. 3A, a pattern piece 300 is depicted, where the pattern piece 300 may be cut from a panel of fabric knitted using, for instance, a single bar Jacquard warp knitting process. The panel of fabric may be knit to have the three linearly oriented compression zones discussed above and the integrated structure patterns. The pattern piece 300 may be used in part to form the training tight 100. For instance, the pattern piece 300 may correspond to a pattern piece for a left leg portion and may be joined to a pattern piece for a right leg portion at one or more seams to form the tight 100. The pattern piece 300, moreover, may cut to a number of different sizes so as to form different sizes of tights 100 and may be shaped differently to form tights for women versus men. Although the pattern piece 300 is shown with a length corresponding to a full tight, it is contemplated that the length may be shortened to form a capri, a half-tight, a three-quarter tight, or a short. The compression zones 116, 118 and 120 are depicted along with the structures/shapes 124, 126, 128, 130 and 132 as shown and described in relation to FIGS. 1 and 2. Moreover, the spacing between the structures that was described above with respect to FIGS. 1 and 2 is better shown in FIG. 3A.

Figure 3B:
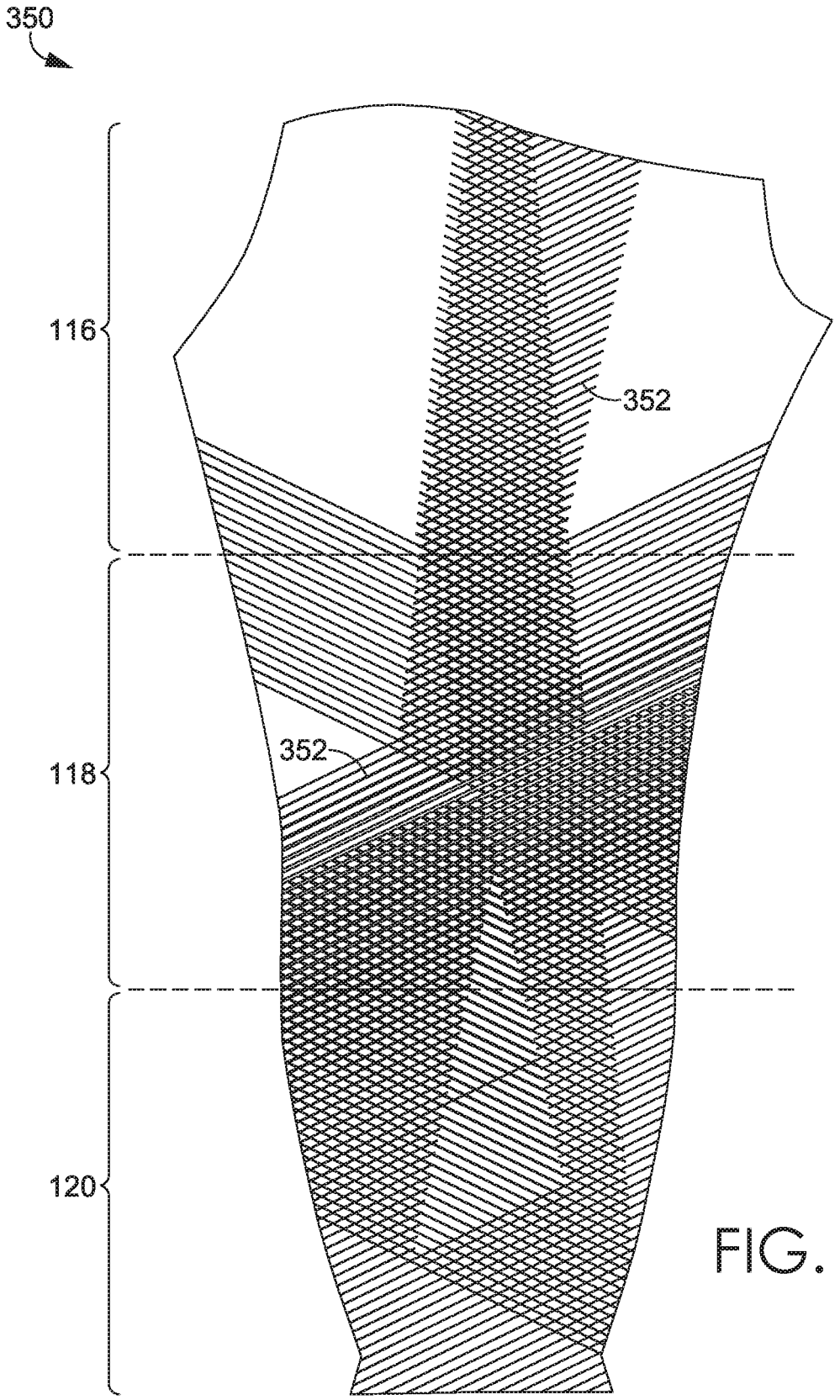
FIG. 3B illustrates an exemplary pattern piece used to construct an exemplary training tight having preconfigured compression zones and integrated structure patterns in accordance with aspects herein.

FIG. 3B illustrates another exemplary pattern piece 350 used to form a training tight having preconfigured compression zones Like the pattern piece 300, the pattern piece 350 may be cut from a panel of fabric knitted using, for example, a single bar Jacquard warp knitting process. The pattern piece 350 is generally similar to the pattern piece 300 with respect to the general location of the compression zones 116, 118, and 120. However, the pattern piece 350 illustrates another exemplary configuration for integrated knit structure patterns 352. For instance, instead of utilizing generally vertically oriented line structures for the second and third compression zone 118 and 120 as described above with respect to, the training tight 100, the line structures may be skewed from the vertical (i.e., diagonal) in the first, second and third compression zones 116, 118 and 120. Moreover, the spacing between adjacent shapes and structures may differ from the pattern piece 300. Any and all aspects, and any variation thereof, are contemplated as being within the scope herein.

Although the zones 116, 118 and 120 are shown in FIGS. 1-3B as generally comprising horizontally oriented bands formed through a single bar Jacquard warp knitting process, it is contemplated herein that the compression zones may comprise organically shaped (e.g., curvilinear) areas. As used in this disclosure, the term "organically shaped" generally means a shape having one or more curved or non-linear segments. For example, when textile panels used to form the exemplary training tight described herein are knit using a double bar Jacquard warp knitting process, one bar may be used to carry the elastic yarns that are used to impart the compression characteristics of the tight, while the other bar may be used to carry other yarns (e.g., polyester yarns) used to form the tights. The bar carrying the elastic yarns may be used to drop in stitches were needed to create more organically shaped compression zones. This may be useful in customizing compression zones for specific muscle groups as the shape of the compression zone can be tailored to the shape of the underlying muscle group.

Figure 10:
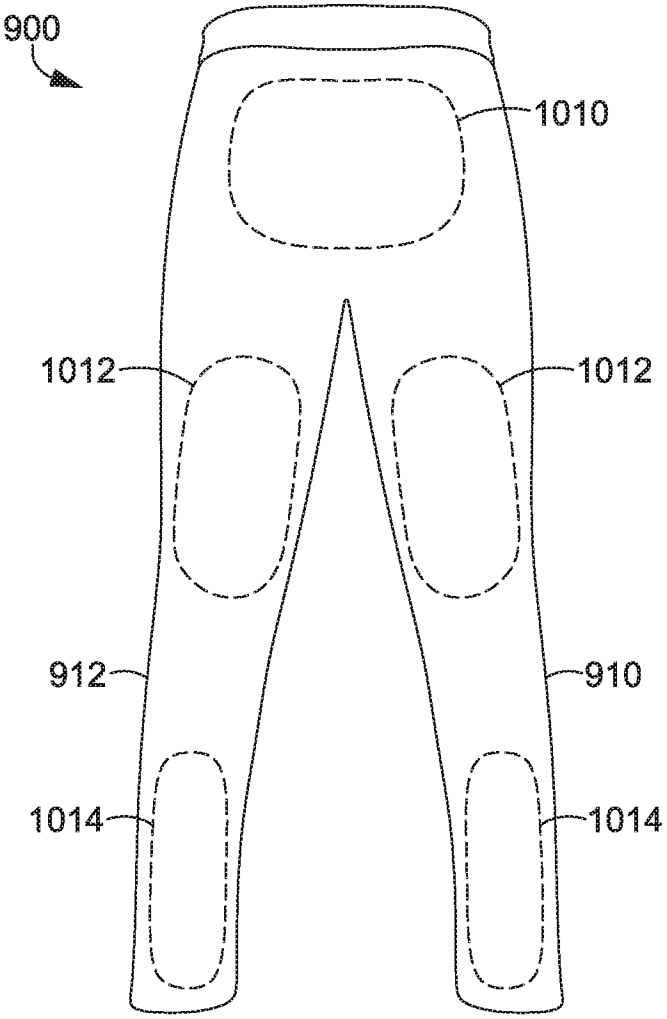
FIG. 10 illustrates a back view of the exemplary training tight of FIG. 9 in accordance with aspects herein.
Figure 9:
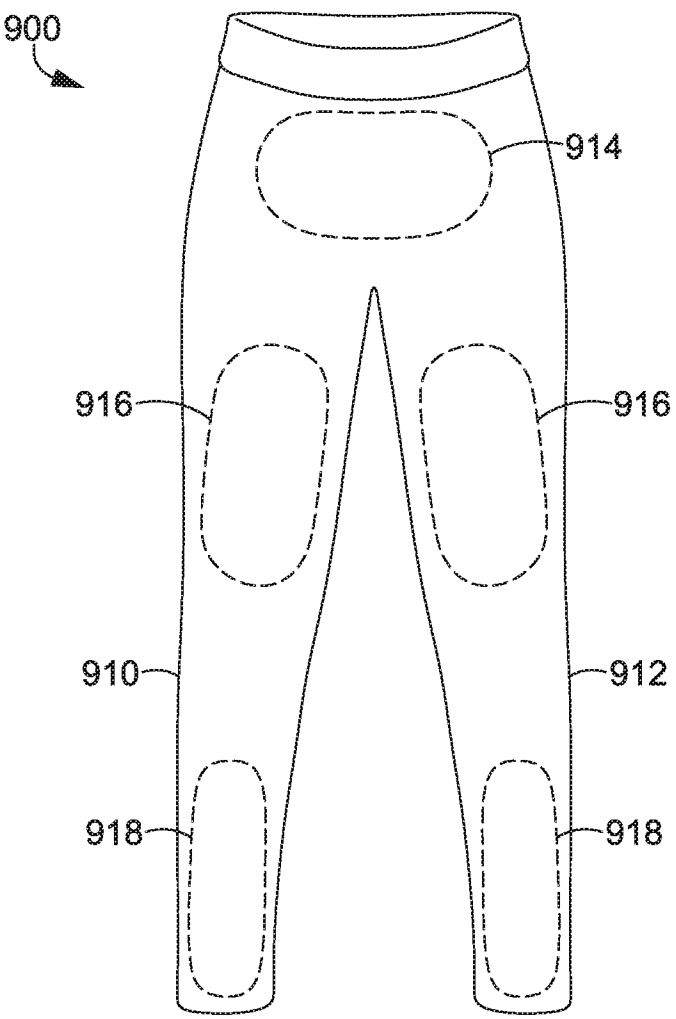
FIG. 9 illustrates a front view of an exemplary training tight with organically shaped compression zones in accordance with aspects herein.

An exemplary training tight incorporating organically shaped compression zones generated through, for instance, a double bar Jacquard warp knitting process is depicted in FIGS. 9 and 10 in accordance with aspects herein. FIG. 9 depicts a front view of an exemplary training tight 900, and FIG. 10 depicts a back view of the exemplary training tight 900. The training tight 900 may have a torso portion, and at least a first leg portion 910 and a second leg portion 912. With respect to FIG. 9, a high modulus compression zone 914 (shown by dashed lines) may be located at an anterior aspect of the torso portion such that it generally is positioned adjacent to a lower abdomen area of a wearer when the tight 900 is worn. The modulus of elasticity values and compression force associated with the zone 914 may be the same or similar to those recited for the first compression zone 116 of the tight 100. Providing a relatively high degree of compression in this area may help to impart core stability to the wearer when the tight 900 is worn.

Compression zones 916 are shown as generally being located on an anterior aspect of the tight 900 at an upper portion of the first leg portion 910 and the second leg portion 912. When the training tight 900 is worn, the compression zones 916 would generally be positioned adjacent to an anterior thigh area of the wearer. The modulus of elasticity values and compression force associated with the compression zones 916 may be the same or similar to those recited for the second compression zone 118 of the tight 100. Because the elastic yarns are dropped in where needed, the compression zones 916 may assume a more organic shape thereby allowing the compression zones 916 to provide a medium level of compression to, for instance, the quadriceps muscle groups of the wearer.

Compression zones 918 are shown as generally being located over an anterior aspect of the lower portions of the first leg portion 910 and the second leg portion 912. When the training tight 900 is worn, the compression zones 918 would be generally positioned adjacent to a shin area of the wearer. The modulus of elasticity values and compression force associated with the compression zones 918 may be the same or similar to those recited for the third compression zone 120 of the tight 100. Because the elastic yarns are dropped in where needed, the compression zones 918 may assume a more organic shape thereby allowing the compression zones 918 to provide a relatively low level of compression to, for instance, the shin area of the wearer.

FIG. 10, which depicts a back view of the tight 900 further depicts compression zone 1010 located over a posterior aspect of the lower torso portion of the tight 900. When worn, the compression zone 1010 would be positioned adjacent to a wearer's buttocks region. The modulus of elasticity values and compression force associated with the compression zone 1010 may be the same or similar to those recited for the first compression zone 116 of the tight 100. Because the elastic yarns are dropped in where needed, the compression zone 1010 may assume a more organic shape thereby allowing the compression zone 1010 to provide a targeted compression to, for instance, the posterior lower torso area of the wearer.

The tight 900 may further comprise compression zones 1012 positioned at a posterior portion of the first leg portion 910 and the second leg portion 912. When worn, the compression zones 1012 would be positioned adjacent to a posterior thigh area of the wearer. The modulus of elasticity values and compression force associated with the compression zones 1012 may be the same or similar to those recited for the second zone 118 of the tight 100. Because the elastic yarns are dropped in where needed, the compression zones 1012 may assume a more organic shape thereby allowing the compression zones 1012 to provide a targeted compression to, for instance, the hamstring muscle groups of the wearer.

Compression zones 1014 may be positioned over a lower posterior portion of the first leg portion 910 and the second leg portion 912. When worn, the compression zones 1014 would be positioned adjacent to the calf muscles of the wearer. The modulus of elasticity values and compression force associated with the compression zones 1014 may be the same or similar to those recited for the third compression zone 120 of the tight 100. Because the elastic yarns are dropped in where needed, the compression zones 1014 may assume a more organic shape thereby allowing the compression zones 1014 to provide a targeted compression to, for instance, the calf muscles of the wearer. Additional organically shaped compression zones are contemplated herein. For instance, a compression zone may be located at an upper, lateral aspect of the tight 900 such that it is positioned adjacent to a wearer's iliotibial (IT) band when the tight 900 is worn. In exemplary aspects, it may be beneficial to apply a moderate degree of compression to this area to further help stabilize the wearer's core.

Although not shown, it is contemplated herein that integrated knit structure patterns may be associated with the compression zones 914, 916, 918, 1010, 1012, and 1014 of the tight 900 to modify the compression force of the compression zones as desired. It is further contemplated herein that the shape configuration for the compression zones may differ from that shown in FIGS. 9 and 10. Moreover, it is contemplated herein that the tight 900 may comprise additional compression zones than those shown, or may comprise fewer compression zones than those shown. Any and all aspects, and any variation thereof, are contemplated as being within aspects herein.

Figure 6:
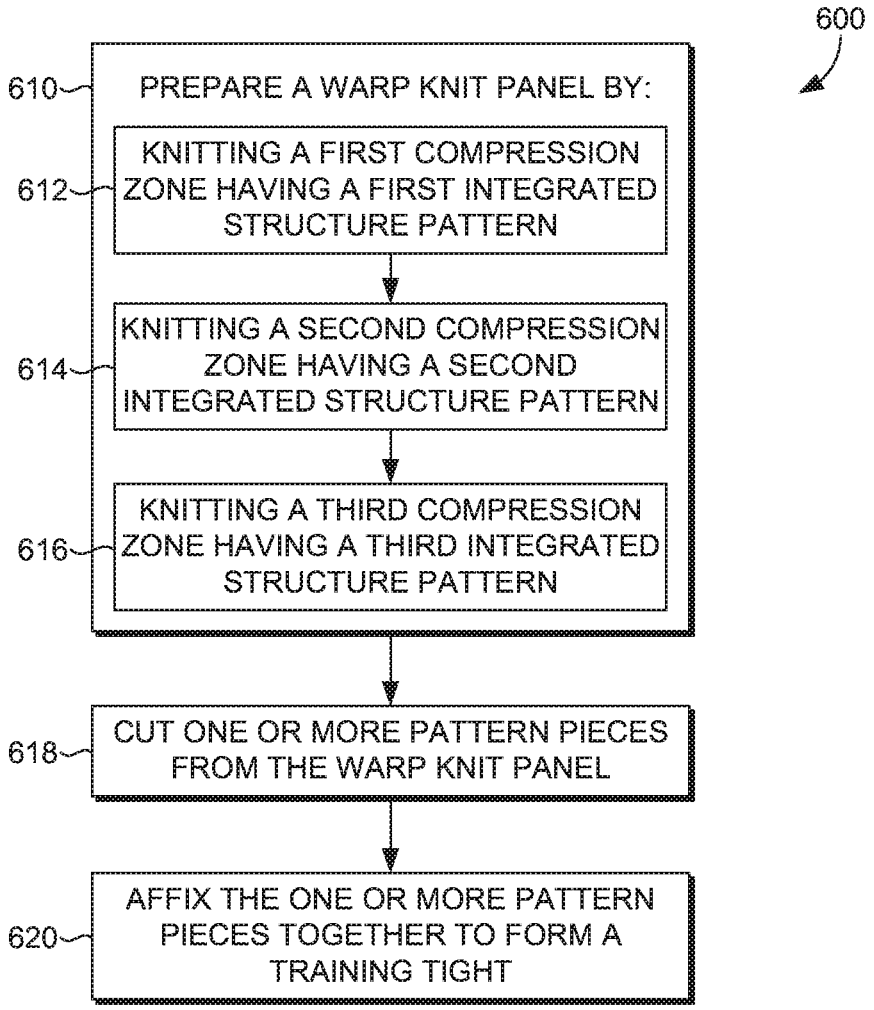
FIG. 6 illustrates a flow diagram of an exemplary method of manufacturing a warp knit training tight having preconfigured compression zones and integrated knit structure patterns in accordance with an aspect herein.

FIG. 6 illustrates a flow diagram of an exemplary method 600 of manufacturing a warp knit training tight such as the training tight 100 and/or the training tight 900. At a step 610, a panel of fabric is prepared. The panel may be prepared by utilizing a warp knitting process (single or double bar Jacquard) to knit a first compression zone, such as the first compression zone 116 and/or the compression zones 914/1010, having a first modulus of elasticity and/or compression force at a step 612. The first compression zone may be formed using one or more elastic yarns having the same or different denier and having a predefined modulus of elasticity. The modulus of elasticity associated with the elastic yarn(s) may be due to the denier and/or diameter of the yarn, and/or due to the type of yarn used. Knitting the first compression zone may further comprise knitting a first integrated knit structure pattern as described herein.

At a step 614, a second compression zone, such as the second compression zone 118 and/or the compression zones 916/1012, is knit where the second compression zone is adjacent to the first compression zone. The second compression zone has a second modulus of elasticity and/or compression force that is less than the first modulus of elasticity and/or compression force associated with the first compression zone. The second compression zone may be formed using one or more elastic yarns having the same or different denier. The modulus of elasticity of the yarns used to knit the second compression zone is less than the modulus of elasticity of the yarns used to knit the first compression zone. Knitting the second compression zone may comprise knitting a second integrated knit structure pattern as described herein.

At a step 616, a third compression zone, such as the third compression zone 120 and/or the compression zones 918/1014, is knit where the third compression zone is adjacent to the second compression zone. The third compression zone has a third modulus of elasticity and/or compression force that is less than the first modulus of elasticity and/or compression force associated with the first compression zone. In exemplary aspects, the third modulus of elasticity and/or compression force may also be less than the second modulus of elasticity and/or compression force associated with the second compression zone 118. The third compression zone may be formed using elastic yarns having a modulus of elasticity less than the modulus of elasticity of the yarns used to knit the first compression zone and, optionally, the second compression zone. Knitting the third compression zone may comprise knitting a third integrated structure pattern as described herein.

Continuing with the method 600, as a step 618, one or more pattern pieces may be cut from the warp knit panel. And at a step 620, the one or more pattern pieces may be affixed together to form the training tight. The pattern pieces may differ when forming a tight for a man versus for a woman, when forming tights of different sizes, and/or when forming the tight as a capri, a half-tight, a three-quarter tight, and the like.

When knitting the panel using, for instance, a single bar Jaquard warp knitting process, the transition between the different compression zones may be configured in a gradient fashion or as more of an abrupt transition. For instance, an abrupt transition between the different compression zones may occur by setting up the warp such that yarns associated with, for instance, a first compression zone may be replaced with the yarns that will be used to form a second compression zone at the junction or demarcation between the two zones.

Figure 7:
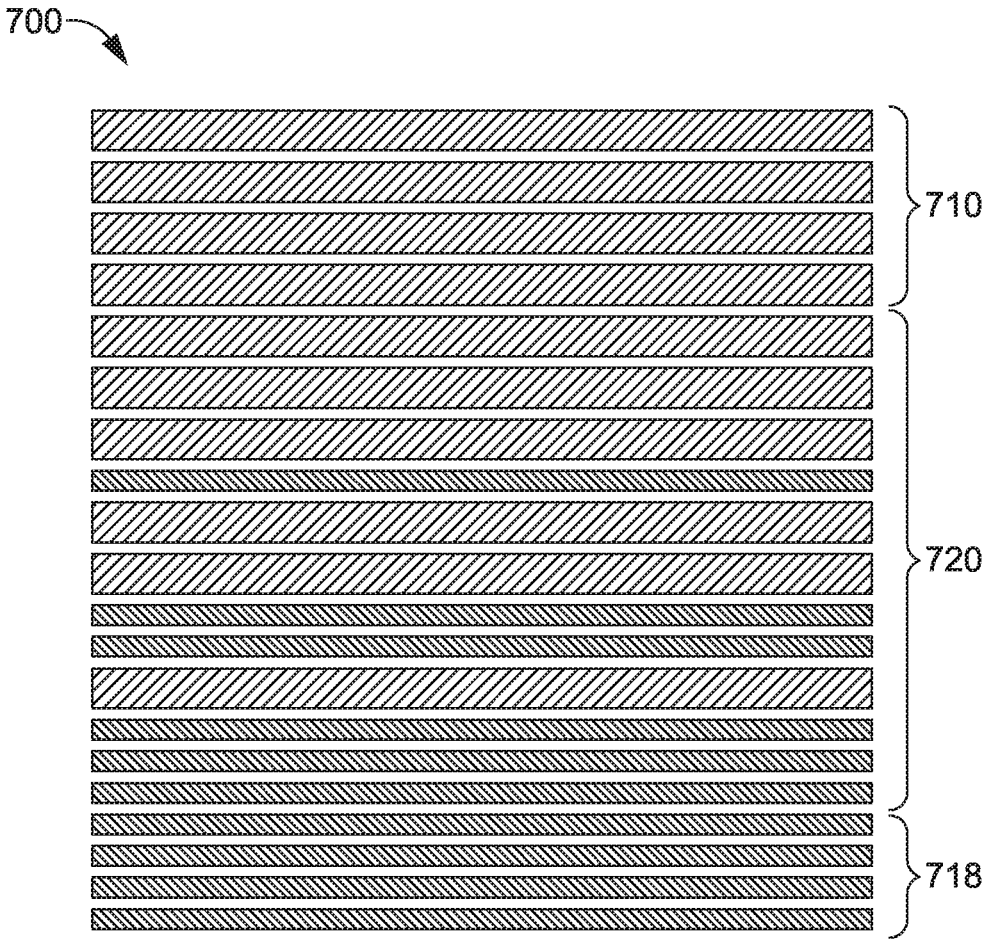
FIG. 7 illustrates a close-up view of an exemplary transition zone between a first compression zone and a second compression zone in accordance with an aspect herein.

In another exemplary aspect, the transition between the different compression zones may occur gradually by setting up the warp such that yarns used to knit a first compression zone are intermixed with yarns used to form a second compression zone at a transition area. An exemplary transition between different compression zones is shown in FIG. 7 and is referenced generally by the numeral 700. Reference numeral 710 indicates a first segment of warp yarns used to form a particular compression zone, such as, for example, the first compression zone 116. The yarns in the first segment 710 may have a large denier or diameter and a high modulus. Segment 718 indicates a second segment of warp yarns used to form, for example, the second compression zone 118. The yarns in the second segment 718 may have a smaller denier or diameter than the yarns in the first segment 710 and a smaller modulus of elasticity. The segment 720 represents the transition area between the first compression zone and the second compression zone. As shown, the yarns of the first segment 710 are intermixed with the yarns of the second segment 718 in the transition segment 720. The pattern of the yarns in the transition segment 720 may vary. For instance, the intermixing of the yarns having the differing deniers may occur in a gradient fashion with the yarns associated with the first segment 710 gradually being replaced with the yarns associated with the second segment 718 so that the concentration of yarns having the larger denier is greater adjacent to the second compression zone and the concentration of yarns having the smaller denier is greater adjacent to the third compression zone. This is just one exemplary pattern and other transition patterns are contemplated herein. Because the transition segment 720 comprises an intermixing of the yarns having the differing deniers and differing moduli of elasticity, the modulus of elasticity of the transition segment 720 may be between the modulus of elasticity of the first segment 710 and the second segment 718.

As described above, the panel may also be knit using a double bar Jacquard warp knitting process that allows the elastic yarns to be dropped in where needed. As such, there may not be a transition area such as that described with respect to FIG. 7 between the different compression areas or zones.

In exemplary aspects, the training tight described herein may have color variation effect that is achieved by one of several methods. In one exemplary aspect, the color variation effect may comprise a dark colored tight with lighter-colored offset areas. This may be achieved by using, for instance, a cationic polyester yarn as the face yarn and, for example, a regular polyester yarn as the back yarn. In this aspect, the elastic yarns are uncolored. During the dyeing process, which may occur prior to the yarns being knitted to form the tight, the cationic polyester yarn may be dyed a dark color and the regular polyester yarn may be dyed a lighter color. By utilizing this stitch configuration and this dyeing process, the offset areas will be lighter in color than the remaining portions of the tight.

In another exemplary aspect, the color variation may comprise an iridescent effect in the solid-colored areas. This may be achieved by using a cationic polyester yarn as the face yarn and a regular polyester yarn as the back yarn. Again, the elastic yarns are uncolored. Similar to above, the cationic polyester yarn may be dyed a dark color and the regular polyester yarn may be dyed a lighter color. However, during the knitting of the tight, the stitch pattern is altered to allow a small amount of the lighter-colored back yarns to show through the dark-colored face yarns, thereby creating the iridescent effect. The offset areas, like above, are lighted colored.

In yet another exemplary aspect, the color variation may comprise a light colored tight with darker-colored offset areas. In this aspect, the regular polyester yarn comprises the face yarn and the cationic polyester yarn comprises the back yarn. During the dyeing process, the cationic polyester yarn may be dyed a dark color and the regular polyester yarn may be dyed a lighter color. By utilizing this dyeing process and this stitch configuration, the offset areas will be darker in color than the remaining portions of the tight.

Continuing, an additional type of iridescent effect may be achieved by using regular polyester yarn as the face yarn and a cationic polyester yarn as the back yarn. The cationic polyester yarn may be dyed a dark color and the regular polyester yarn may be dyed a lighter color. During the knitting of the tight, the stitch pattern is altered to allow a small amount of the darker-colored back yarn to show through light-colored face yarn, thereby creating the iridescent effect. The offset area are dark colored in this aspect.

In exemplary aspects, the elastic yarns may be covered with a polyester or cationic polyester yarn during spinning. The covered elastic yarn may then be dyed and incorporated into the tight in a manner similar to those described above to create the color variation effects noted above. Any and all such aspects, and any variation thereof, are contemplated as being within the scope herein.

Figure 8:
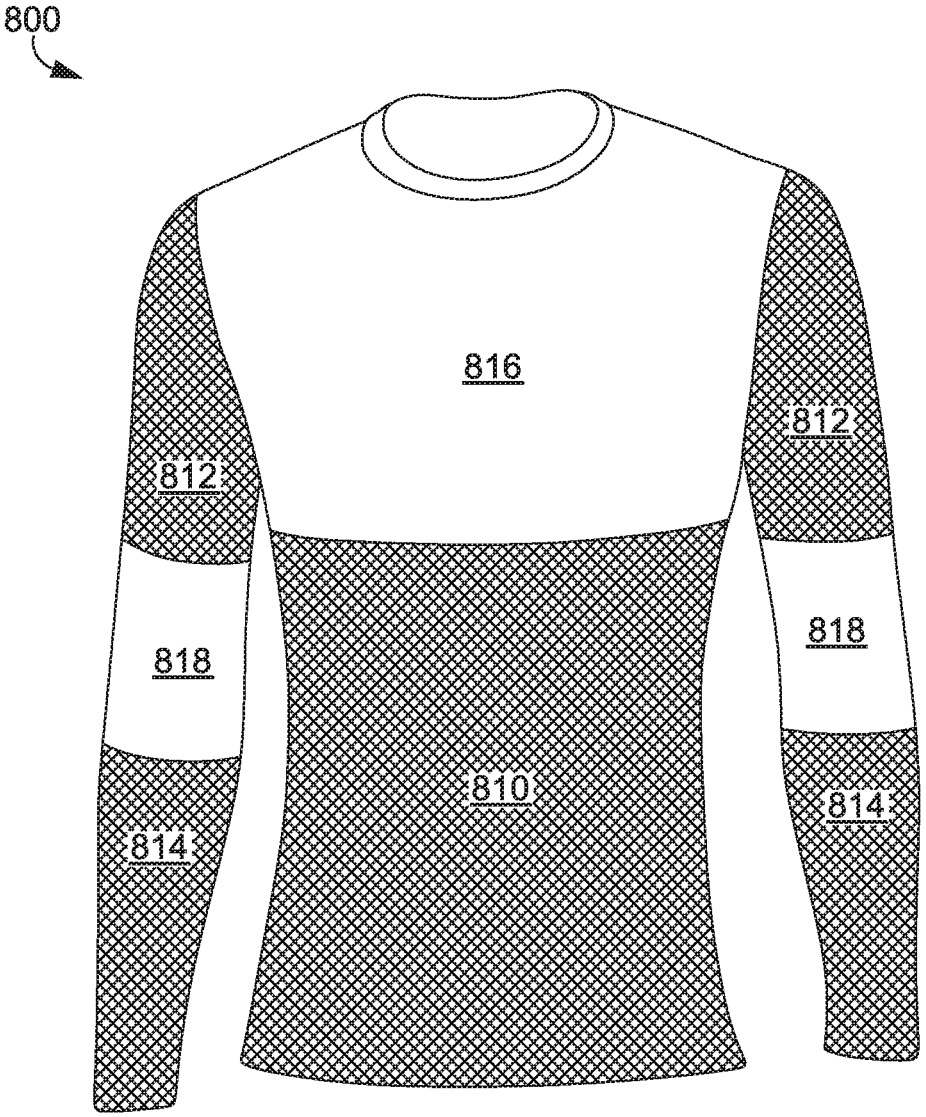
FIG. 8 illustrates an exemplary article of apparel for an upper torso of a wearer, the article of apparel having preconfigured compression zones in accordance with an aspect herein.

FIG. 8 illustrates an exemplary article of apparel 800 for an upper torso of a wearer in accordance with an aspect herein. The article of apparel 800 is in the form of a long-sleeve shirt although other articles are contemplated herein such as a sleeveless tank top, a camisole, a bra, a short-sleeved shirt, and the like. The article of apparel 800 may be formed from a warp knitted fabric (single or double bar Jacquard), where the fabric is knitted to have different compression zones and/or different integrated knit structure patterns as described herein. In the exemplary aspect shown in FIG. 8, the article of apparel 800 is configured to have high compression zones over the wearer's torso area 810, upper arm area 812, and lower arm area 814, and low to medium compression zones over the wearer's upper chest area 816, and elbow area 818. This configuration may, for instance, further help to stabilize the wearer's core, and minimize muscle vibration in the wearer's biceps and triceps while still providing mobility over the wearer's shoulder area and elbow area.

The configuration shown in FIG. 8 is exemplary only and it is contemplated herein that additional compression zone configurations may be used to achieve different functional purposes. For example, a high compression zone may be located over the wearer's lower back to help stabilize this area. Moreover, the integrated knit structure pattern in the form of repeating diamonds shown in FIG. 8 is exemplary only and it is contemplated herein that the apparel item 800 may have different structure patterns such as those shown in FIGS. **5A-5*s* or may not have any integrated structure patterns. Further, these structure patterns may be in different locations than those shown in FIG. 8**. Any and all such aspects, and any variation thereof, are contemplated as being within the scope herein. The structure patterns may be used to further customize the amount of compression or the direction of compression associated with one or more of the compression zones as discussed herein.

From the foregoing, it will be seen that aspects herein are well adapted to attain all the ends and objects hereinabove set forth together with other advantages which are obvious and which are inherent to the structure. It will be understood that certain features and subcombinations are of utility and may be employed without reference to other features and subcombinations. This is contemplated by and is within the scope of the claims. Since many possible aspects may be made without departing from the scope thereof, it is to be understood that all matter herein set forth or shown in the accompanying drawings is to be interpreted as illustrative and not in a limiting sense.

What is claimed is:

1. An article of apparel having an outer-facing surface, the article of apparel comprising:

a plurality of compression zones, wherein:

each of the plurality of compression zones has a modulus of elasticity value within a predefined range, and one or more of the plurality of compression zones has an integrated structure pattern comprising a plurality of offset areas extending inwardly from the outer-facing surface of the article of apparel, the plurality of offset areas comprising a shorter length knit stitch, wherein the plurality of offset areas delineate and define a plurality of structures, and wherein a spacing between adjacent structures of the plurality of structures varies within the integrated structure pattern.

2. The article of apparel of claim 1, wherein the article of apparel is warp knitted.

3. The article of apparel of claim 1, wherein the integrated structure pattern is located at preconfigured locations within the one or more of the plurality of compression zones.

4. The article of apparel of claim 1, wherein the shorter length knit stitch used to form the plurality of offset areas comprises a shorter length compared to a knit stitch used to form the plurality of structures.

5. The article of apparel of claim 1, wherein the adjacent structures of the plurality of structures are spaced apart from one another by the plurality of offset areas.

6. The article of apparel of claim 1, wherein the variation in the spacing between the adjacent structures of the plurality of structures modifies the modulus of elasticity value at preconfigured locations within the one or more of the plurality of compression zones.

7. The article of apparel of claim 1, wherein an increase in the spacing between the adjacent structures of the plurality of structures increases the modulus of elasticity value at preconfigured locations within the one or more of the plurality of compression zones a greater amount compared to a decrease in the spacing between the adjacent structures of the plurality of structures.

8. The article of apparel of claim 1, wherein the article of apparel is a tight.

9. The article of apparel of claim 1, wherein the article of apparel is a shirt.

10. An article of apparel having an outer-facing surface, the article of apparel comprising:

a first compression zone having a first modulus of elasticity value within a predefined range; and a second compression zone having a second modulus of elasticity value within a predefined range, wherein one or more of the first compression zone and the second compression zone comprise an integrated structure pattern comprising a plurality of offset areas extending inwardly from the outer-facing surface of the article of apparel, the plurality of offset areas comprising a shorter length knit stitch, wherein the plurality of offset areas delineate and define a plurality of structures, and wherein a spacing between adjacent structures of the plurality of structures varies within the integrated structure pattern.

11. The article of apparel of claim 10, wherein the first modulus of elasticity value is different than the second modulus of elasticity value.

12. The article of apparel of claim 10, wherein the adjacent structures of the plurality of structures are spaced apart from one another by the plurality of offset areas.

13. The article of apparel of claim 10, wherein the variation in the spacing between the adjacent structures of the plurality of structures modifies one or more of the first modulus of elasticity value and the second modulus of elasticity value at preconfigured locations within the one or more of the first compression zone and the second compression zone.

14. The article of apparel of claim 10, wherein an increase in the spacing between the adjacent structures of the plurality of structures increases the modulus of elasticity value at preconfigured locations within the one or more of the first compression zone and the second compression zone a greater amount compared to a decrease in the spacing between the adjacent structures of the plurality of structures.

15. An article of apparel having an outer-facing surface, the article of apparel comprising:

a plurality of compression zones, wherein:

one or more of the plurality of compression zones has an integrated structure pattern comprising a plurality of offset areas extending inwardly from the outer-facing surface of the article of apparel, the plurality of offset areas comprising a shorter length knit stitch, wherein the plurality of offset areas delineate and define a plurality of structures, and wherein a spacing between adjacent structures of the plurality of structures varies within the integrated structure pattern.

16. The article of apparel of claim 15, wherein the article of apparel is an upper torso article of apparel.

17. The article of apparel of claim 15, wherein the article of apparel is a lower torso article of apparel.

18. The article of apparel of claim 15, wherein the adjacent structures of the plurality of structures are spaced apart from one another by the plurality of offset areas.

19. The article of apparel of claim 15, wherein the variation in the spacing between the adjacent structures of the plurality of structures modifies a modulus of elasticity value at preconfigured locations within the one or more of the plurality of compression zones.

20. The article of apparel of claim 19, wherein an increase in the spacing between the adjacent structures of the plurality of structures increases the modulus of elasticity value at the preconfigured locations a greater amount compared to a decrease in the spacing between the adjacent structures of the plurality of structures.

* * * * *